US009395640B2

(12) United States Patent
Yoshie et al.

(10) Patent No.: US 9,395,640 B2
(45) Date of Patent: Jul. 19, 2016

(54) LIQUID DEVELOPER

(71) Applicant: KONICA MINOLTA, INC., Chiyoda-ku (JP)

(72) Inventors: Naoki Yoshie, Ibaraki (JP); Masahiro Anno, Sakai (JP); Yukiko Uno, Kyoto (JP); Masaaki Oka, Kyoto (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/306,278

(22) Filed: Jun. 17, 2014

(65) Prior Publication Data

US 2014/0370436 A1 Dec. 18, 2014

(30) Foreign Application Priority Data

Jun. 18, 2013 (JP) ..... 2013-127523

(51) Int. Cl.
*G03G 9/13* (2006.01)
*G03G 9/125* (2006.01)

(52) U.S. Cl.
CPC ..... *G03G 9/132* (2013.01); *G03G 9/125* (2013.01)

(58) Field of Classification Search
CPC ..... G03G 9/132; G03G 9/125
USPC ..... 430/114, 112, 116
See application file for complete search history.

(56) References Cited

U.S. PATENT DOCUMENTS 4,608,325 A * 8/1986 Ismail ..... 429/217
6,146,804 A 11/2000 Miyamoto et al.
2003/0099894 A1 5/2003 Tsubuko et al.
2008/0299481 A1 12/2008 Akioka
2009/0253067 A1* 10/2009 Yoshie ..... G03G 9/08797 430/114
2014/0087304 A1* 3/2014 Uno et al. ..... 430/114

FOREIGN PATENT DOCUMENTS

JP 5-188659 A 7/1993
JP 10-333366 A 12/1998
JP 2002-356635 A 12/2002
JP 2003-020423 A 1/2003
JP 2005-062466 A 3/2005
JP 2008-299142 A 12/2008
JP 2009-096994 A 5/2009

OTHER PUBLICATIONS

Fisher Scientific Material Satefy Data Sheet (MSDS) for product "mineral oil," revised Jan. 29, 2010.*

* cited by examiner

*Primary Examiner* — Janis L Dote
(74) *Attorney, Agent, or Firm* — Buchanan Ingersoll & Rooney PC

(57) ABSTRACT

A liquid developer includes an insulating liquid and toner particles dispersed in the insulating liquid. The insulating liquid has a flash point not lower than 100° C. The toner particles contain a resin, and the resin contains 80 mass % or more of a first resin containing a component derived from a polyester resin. A solid content of the liquid developer corresponding to a portion of the liquid developer excluding the insulating liquid satisfies relation of $G'(T_0)/G'(T_0+10) \geq 10$ ($50° C. \leq T_0 \leq 70° C.$), where $G'(T_0)$ represents a storage elastic modulus at a temperature $T_0$ (° C.) and $G'(T_0+10)$ represents a storage elastic modulus at a temperature ($T_0+10$) (° C.).

5 Claims, 2 Drawing Sheets

LIQUID DEVELOPER

This application is based on Japanese Patent Application No. 2013-127523 filed with the Japan Patent Office on Jun. 18, 2013, the entire content of which is hereby incorporated by reference.

BACKGROUND OF THE INVENTION

1. Field of the Invention

The present invention relates to a liquid developer containing an insulating liquid and toner particles dispersed in the insulating liquid.

2. Description of the Related Art

Decrease in energy required for fixation (fixation energy) has been desired with the tendency toward energy saving, and various proposals have been made. For example, Japanese Laid-Open Patent Publication No. 2008-299142 describes use of toner particles including a liquid lower in aniline point than an insulating liquid. Japanese Laid-Open Patent Publication No. 2005-62466 describes use as a main component of a resin contained in a liquid developer, of a crystalline polyester resin of which melt mass flow rate measured at 150±0.4° C. under the load of 2160±10 g based on JIS K7210 is from 10 to 1200 g/10 min. Japanese Laid-Open Patent Publications Nos. 2003-20423 and 2002-356635 describe lowering in softening point of a resin contained in a liquid developer. Japanese Laid-Open Patent Publications Nos. 10-333366 and 5-188659 describe optimization of melt viscosity around 100° C. in a dry state of toner particles. Fixation at a paper temperature from around 70 to 80° C. has recently been desired, and in order to realize such fixation, a liquid developer is preferably softened at 50 to 70° C.

SUMMARY OF THE INVENTION

Decrease in fixation energy leads to likeliness of melt of a resin at a low temperature, and hence high-temperature offset is more likely.

The present invention provides a liquid developer capable of achieving prevention of occurrence of high-temperature offset while fixation energy is decreased.

A liquid developer according to the present invention includes an insulating liquid and toner particles dispersed in the insulating liquid. The insulating liquid has a flash point not lower than 100° C. The toner particles contain a resin, and the resin contains 80 mass % or more of a first resin containing a component derived from a polyester resin. A solid content of the liquid developer corresponding to a portion of the liquid developer excluding the insulating liquid satisfies relation of $G'(T_0)/G'(T_0+10)\geq 10$ (50° C.$\leq T_0 \leq$70° C.) and preferably $G'(T_0)/G'(T_0+10)\geq 50$, where $G'(T_0)$ represents a storage elastic modulus at a temperature $T_0$ (° C.) and $G'(T_0+10)$ represents a storage elastic modulus at a temperature $(T_0+10)$ (° C.). Here, temperature $T_0$ can be found in accordance with a method shown below. On a graph satisfying relation of 50° C.$\leq T_0 \leq$70° C. in which temperature dependency of a storage elastic modulus of a solid content of a liquid developer is plotted, with the abscissa representing a temperature T and the ordinate representing a storage elastic modulus G'(T), any two points are approximated by a straight line to thereby find a gradient, and a temperature at which the gradient is greatest is defined as $T_0$.

The component derived from the polyester resin preferably contains a constitutional unit derived from an acid component and a constitutional unit derived from an alcohol component. A ratio of a constitutional unit derived from an aliphatic monomer occupied in the constitutional unit derived from the acid component and the constitutional unit derived from the alcohol component is preferably not lower than 90 mass %. The first resin is preferably at least one of the polyester resin and a urethane-modified polyester resin resulting from increase in chain length of the component derived from the polyester resin by a compound containing an isocyanate group. The resin preferably contains 90 mass % or more of the first resin.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
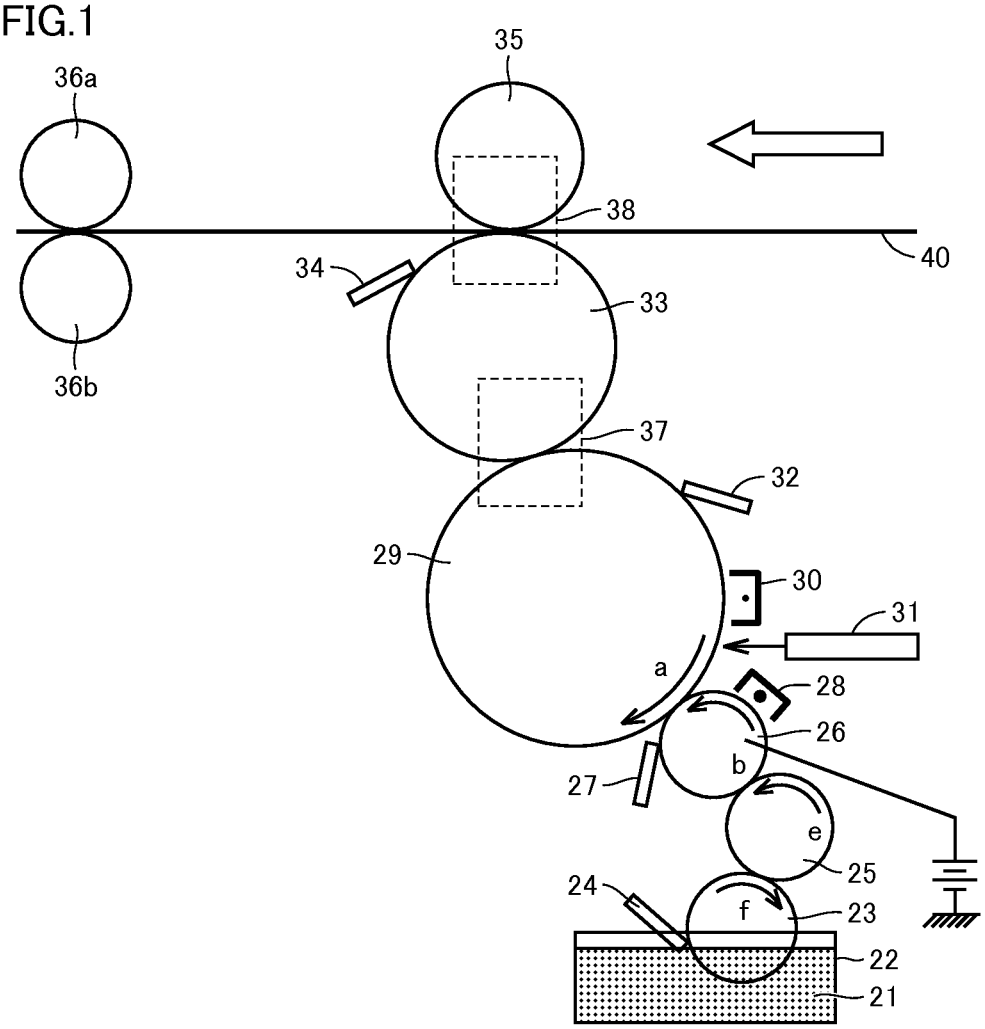
FIG. 1 is a schematic conceptual diagram of an image formation apparatus of an electrophotography type.

A liquid developer according to the present invention will be described below. It is noted that the same reference numerals in the drawings of the present invention refer to the same or corresponding elements. Relation of such a dimension as a length, a width, a thickness, or a depth is modified as appropriate for clarity and brevity of the drawings and does not represent actual dimensional relation.

<Liquid Developer>

A liquid developer according to the present embodiment is useful as a liquid developer for electrophotography used in an image formation apparatus of an electrophotography type (which will be described later) such as a copying machine, a printer, a digital printer, or a simple printer, a paint, a liquid developer for electrostatic recording, an oil-based ink for ink jet printer, or an ink for electronic paper, and it includes an insulating liquid and toner particles dispersed in the insulating liquid. In the liquid developer according to the present embodiment, a solid content of the liquid developer corresponding to a portion of the liquid developer excluding the insulating liquid (corresponding to toner particles; hereinafter denoted as a "solid content of the liquid developer") satisfies relation of $G'(T_0)/G'(T_0+10)\geq 10$ (50° C.$\leq T_0 \leq$70° C.; to be understood similarly hereinafter), where $G'(T_0)$ represents a storage elastic modulus at a temperature $T_0$ (° C.) and $G'(T_0+10)$ represents a storage elastic modulus at a temperature $(T_0+10)$ (° C.). Thus, since the liquid developer according to the present embodiment is excellent in sharp-melting capability at a low temperature, fixation at a low temperature (for example, from 70 to 80° C.) can be achieved. Therefore, the liquid developer according to the present embodiment can achieve decrease in fixation energy. A conventional attempt for decrease in fixation energy has led to occurrence of high-temperature offset. In the present embodiment, however, since the insulating liquid has a flash point not lower than 100° C., it is high in viscosity and low in volatility, and likely to remain on a surface of the toner particles during fixation. Thus, the liquid developer according to the present embodiment can achieve decrease in fixation energy and prevention of occurrence of high-temperature offset.

<$G'(T_0)/G'(T_0+10)$>

As $G'(T_0)/G'(T_0+10)$ is higher, the liquid developer is better in sharp-melting capability, and hence further decrease in fixation temperature can be achieved. Thus, further decrease in fixation energy can be achieved. For example, relation of $G'(T_0)/G'(T_0+10)\geq 50$ is preferably satisfied. Since it is difficult to satisfy relation of $G'(T_0)/G'(T_0+10)>300$, relation of $G'(T_0)/G'(T_0+10)\leq 300$ is preferably satisfied. If relation of $G'(T_0)/G'(T_0+10)\leq 10$ is satisfied, the liquid developer is not excellent in sharp-melting capability, and hence it becomes difficult to achieve decrease in fixation energy. Since it is difficult to ensure meltability of a resin (a resin contained in toner particles) at a target paper temperature (for example, from 70 to 80° C.), fixability is lowered and gloss of an image formed on such a recording medium as paper is also lowered.

A specific method of satisfying relation of $G'(T_0)/G'(T_0+10)\geq 10$ is exemplified, for example, by inclusion of 80 mass % or more of a first resin (a resin containing a component derived from a polyester resin), in a resin contained in toner particles, the first resin having crystallinity, or a second resin having crystallinity. If a ratio of a constitutional unit derived from an aliphatic monomer occupied in a constitutional unit derived from an acid component and a constitutional unit derived from an alcohol component is high, crystallinity of the first resin is high. Thus, relation of $G'(T_0)/G'(T_0+10)\geq 10$ can be satisfied. The constitutional unit derived from the acid component and the constitutional unit derived from the alcohol component are both included in a component derived from the polyester resin.

A specific method of satisfying relation of $G'(T_0)/G'(T_0+10)\geq 50$ is the same as above, and exemplified by enhancing crystallinity of the first resin or the second resin. For example, if a ratio of a constitutional unit derived from an aliphatic monomer occupied in a constitutional unit derived from an acid component and a constitutional unit derived from an alcohol component is not lower than 90 mass %, relation of $G'(T_0)/G'(T_0+10)\geq 50$ can be satisfied.

A storage elastic modulus herein means viscoelasticity of a sample measured with a viscoelasticity measurement apparatus manufactured by TA Instruments, Japan, with a measurement start temperature being set to 40° C., a rate of temperature increase being set to 3° C./min., and a frequency being set to 1 Hz.

<Insulating Liquid>

An insulating liquid is higher in viscosity and less likely to volatile as a flash point thereof is higher. Since the insulating liquid is likely to remain on a surface of toner particles during fixation, occurrence of high-temperature offset tends to be prevented. For example, an insulating liquid has a flash point preferably not lower than 100° C. and not higher than 200° C. and it is composed preferably of aliphatic hydrocarbon, alicyclic hydrocarbon, aromatic hydrocarbon, halogenated hydrocarbon, or polysiloxane. In the liquid developer according to the present embodiment, two or more types of insulating liquids may be mixed. A flash point of an insulating liquid herein was measured in compliance with the Cleveland open cup method under JIS K2265.

Aliphatic hydrocarbon has a carbon number preferably not smaller than 15 and not greater than 50 and more preferably not smaller than 20 and not greater than 35.

Halogenated hydrocarbon is preferably any halogenated compound of aliphatic hydrocarbon, alicyclic hydrocarbon, and aromatic hydrocarbon.

The insulating liquid has a resistance value preferably to such an extent as not distorting an electrostatic image (approximately from 101 to $10^{16}$ Ω·cm) and preferably it is composed, for example, of a solvent having low odor and toxicity. From such a point of view, the insulating liquid is preferably made of a normal paraffin based solvent or an isoparaffin based solvent, and more preferably, for example, MORESCO WHITE (manufactured by MORESCO Corporation), ISOPAR M (manufactured by Exxon Mobil Corporation), or IP SOLVENT 2835 (manufactured by Idemitsu Kosan Co., Ltd.) is employed. A concentration in the liquid developer, of a solid content of the liquid developer is preferably not lower than 1 mass % and not higher than 60 mass %, and hence a content of the insulating liquid in the liquid developer is preferably determined in consideration thereof. The liquid developer according to the present embodiment may contain an organic solvent different from the insulating liquid.

<Toner Particles>

A median diameter D50 found through measurement of particle size distribution of toner particles based on volume (hereinafter denoted as "median diameter D50 of toner particles") is preferably not smaller than 0.5 μm and not greater than 5.0 μm. This particle size is smaller than a particle size of toner particles contained in a dry developer which has conventionally been used and represents one of the features of the present invention. If median diameter D50 of toner particles is smaller than 0.5 μm, toner particles have too small a particle size and hence mobility of toner particles in electric field may become poor, which may lead to lowering in development performance. If median diameter D50 of toner particles exceeds 5.0 μm, uniformity in particle size of toner particles may be lowered, which may lead to lowering in image quality. A method of measuring median diameter D50 of toner particles includes, for example, measurement using a commercially available particle size analyzer (such as SALD-3100 manufactured by Shimadzu Corporation or FPIA-3000 manufactured by Sysmex Corporation).

Average circularity of toner particles is preferably not lower than 0.85 and not higher than 0.96 and a standard deviation of circularity of toner particles is preferably not lower than 0.01 and not higher than 0.1. Circularity of toner particles is represented as a value obtained by calculating (a circumferential length of a circle equal in area to a projection area of toner particles)+(a circumferential length of sensed toner particles) and it is a value found through calculation with the toner particles being optically sensed. Such a value can be measured, for example, with a flow particle image analyzer (FPIA-3000S manufactured by Sysmex Corporation). Since this analyzer can use a solvent as it is as a dispersion medium, this analyzer can measure a state of toner particles in a state closer to an actually dispersed state, as compared with a system in which measurement is conducted in a water system.

From a point of view of fixability of toner particles and heat-resistance stability of a liquid developer, the liquid developer contains preferably 10 to 50 mass %, more preferably 15 to 45 mass %, and further preferably 20 to 40 mass % of toner particles. Such toner particles contain a resin and preferably further contain an additive such as a coloring agent.

<Resin>

A resin contains 80 mass % or more and preferably 90 mass % or more of a first resin containing a component derived from a polyester resin (hereinafter simply denoted as a "first resin"). The polyester resin has been known to be excellent in crystallinity. Therefore, if the resin contained in toner particles contains 80 mass % or more of the first resin, the resin contained in toner particles is excellent in sharp-melting capability, and a liquid developer excellent in sharp-melting capability can be provided. Therefore, decrease in fixation energy can be achieved. If the resin contained in toner particles contains 90 mass % or more of the first resin, the resin contained in toner particles is better in sharp-melting capability, and hence a liquid developer better in sharp-melting capability can be provided. Therefore, further decrease in fixation energy can be achieved. Here, a method of finding a content of the first resin in a resin contained in toner particles includes, for example, a method of calculation based on measurement of an infrared absorption spectrum, a method of calculation based on a spectrum obtained from in nuclear magnetic resonance, or a method of measurement with a GCMS (gas chromatograph mass spectrometer). The "component derived from the polyester resin" means a polyester resin from which one or more atoms have been removed from terminal end(s), and it includes a polyester resin from which one hydrogen atom has been removed from each of opposing terminal ends and a polyester resin from which one hydrogen atom has been removed from one terminal end.

The first resin is, for example, preferably a polyester resin or a urethane-modified polyester resin resulting from increase in chain length of a component derived from a polyester resin by a compound containing an isocyanate group (hereinafter simply denoted as a "urethane-modified polyester resin). If the first resin contained in toner particles contains a urethane-modified polyester resin, the first resin is higher in crystallinity, and hence the first resin is excellent in toughness. Therefore, fixability of toner particles is improved. If fixability of toner particles is improved, adhesiveness of toner particles to a recording medium is good and hence occurrence of document offset can be prevented. In order to effectively achieve such an effect, the first resin contains preferably 80 mass % or more and 100 mass % or less of a urethane-modified polyester resin and more preferably it consists of a urethane-modified polyester resin. Whether or not the first resin contains a urethane-modified polyester resin or a content of a urethane-modified polyester resin in the first resin can be determined, for example, by measuring an infrared absorption spectrum, measuring a nuclear magnetic resonance spectrum, or conducting analysis using a GCMS. A "chain length" means bonding between a component derived from a polyester resin and a compound containing an isocyanate group such that the urethane-modified polyester resin is linear. The "component derived from a polyester resin" means a polyester resin itself if the first resin is a polyester resin, and means a portion of the first resin excluding a portion derived from an isocyanate group if the first resin is a urethane-modified polyester resin.

For similar reasons, a concentration of a urethane group in a urethane-modified polyester resin [(a mass of a urethane group in a urethane-modified polyester resin)/(a mass of the urethane-modified polyester resin)×100] is preferably not lower than 0.5% and not higher than 5% and more preferably not lower than 1% and not higher than 3%. A concentration of a urethane group in a urethane-modified polyester resin is measured with a method shown below. Initially, under conditions shown below (conditions for pyrolysis of a urethane-modified polyester resin), a urethane-modified polyester resin is pyrolyzed. Then, a concentration of a urethane group in the pyrolyzed urethane-modified polyester resin is measured under conditions shown below (conditions for measurement of a concentration of a urethane group in the urethane-modified polyester resin).

(Conditions for Pyrolysis of Urethane-Modified Polyester Resin)

Apparatus: PY-2020iD manufactured by Frontier Laboratories Ltd.

Mass of Sample: 0.1 mg

Heating Temperature: 550° C.

Heating Time Period: 0.5 minute (Conditions for Measurement of Concentration of Urethane Group in Urethane-Modified Polyester Resin)

Apparatus: GCMS-QP2010 manufactured by Shimadzu Corporation

Column: ULTRAALLOY-5 manufactured by Frontier Laboratories Ltd. (inner diameter: 0.25 mm, length: 30 m, thickness: 0.25 μm)

Temperature Increase Condition: Temperature Increase Range: 100° C. to 320° C. (held at 320° C.), Rate of Temperature Increase: 20° C./min.

The "first resin having high crystallinity" means that a ratio between a softening point of the first resin (hereinafter abbreviated as "Tm") and a maximum peak temperature (hereinafter abbreviated as "Ta") of heat of fusion of the first resin (Tm/Ta) is not lower than 0.8 and not higher than 1.55 and that a result of change in amount of heat obtained in differential scanning calorimetry (DSC) does not show stepwise change in amount of heat absorption but has a clear heat absorption peak. A ratio between Tm and Ta (Tm/Ta) being higher than 1.55 can mean that such a resin is not excellent in crystallinity and also that such a resin has non-crystallinity.

A flow tester (capillary rheometer) (such as CFT-500D manufactured by Shimadzu Corporation) can be used to measure Tm. Specifically, while 1 g of a sample is heated at a temperature increase rate of 6° C./min., a plunger applies load of 1.96 MPa to the sample to thereby extrude the sample from a nozzle having a diameter of 1 mm and a length of 1 mm. Relation between "an amount of lowering of the plunger (a value of flow)" and a "temperature" is plotted in a graph. A temperature at the time when an amount of lowering of the plunger is ½ of a maximum value of the amount of lowering is read from the graph, and this value (a temperature at which half of the measurement sample was extruded from the nozzle) is adopted as Tm.

A differential scanning calorimeter (such as "DSC210" manufactured by Seiko Instruments, Inc.) can be used to measure Ta. Specifically, a sample is molten at 130° C., thereafter a temperature is lowered from 130° C. to 70° C. at a rate of 1.0° C./min., and thereafter a temperature is lowered from 70° C. to 10° C. at a rate of 0.5° C./min. Thereafter, with the DSC method, a temperature of the sample is raised at a temperature increase rate of 20° C./min., change in heat absorption and generation of the sample is measured, and relation between an "amount of heat absorption and generation" and a "temperature" is plotted in a graph. Here, a temperature of a heat absorption peak observed in a range from 20 to 100° C. is defined as Ta'. When there are a plurality of heat absorption peaks, a temperature of a peak largest in amount of heat absorption is defined as Ta'. After the sample was stored for 6 hours at (Ta'−10°) C, it is in turn stored for 6 hours at (Ta'−15)° C.

After pre-treatment of the sample ends, with the DSC method, the sample subjected to the pre-treatment above is cooled to 0° C. at a temperature lowering rate of 10° C./min., and then a temperature is raised at a temperature increase rate of 20° C./min. Based on change in heat absorption and generation thus measured, relation between an "amount of heat absorption and generation" and a "temperature" is plotted in a graph. A temperature at which an amount of heat absorption attains to a maximum value is defined as a maximum peak temperature (Ta) of heat of fusion.

In a case where the first resin is high in crystallinity, the first resin preferably satisfies the following Equations (1) to (2) below. In Equations (1) to (2) below, H1 represents heat of fusion (J/g) at the time of initial temperature increase with DSC and H2 represents heat of fusion (J/g) at the time of second temperature increase with DSC. H1 and H2 can be measured in compliance with "testing methods for heat of transitions of plastics" under JIS-K7122 (2012). Specifically, initially, 5 mg of the first resin is taken and introduced in an aluminum pan together with standard polyester. With a differential scanning calorimetry apparatus (such as RDC220 manufactured by SII Nano Technology Inc. or DSC20 manufactured by Seiko Instruments Inc.) and with a rate of temperature increase from 0° C. to 180° C. being set to 10° C./min., a temperature at a heat absorption peak of the first resin owing to melting (melting point) is measured and an area S1 of a heat absorption peak is found. H1 can be calculated from found area S1 of the heat absorption peak. After H1 is calculated, a rate of cooling is set to 90° C./min., thereafter cooling to 0° C. is carried out, a rate of temperature increase is set to 10° C./min., a temperature at a heat absorption peak of the first resin owing to melting (melting point) is measured, and an area S2 of a heat absorption peak is found. H2 can be calculated from found area S2 of the heat absorption peak. Twelve TSK standard POLYSTYRENEs manufactured by Tosoh Corporation (molecular weight: 500, 1050, 2800, 5970, 9100, 18100, 37900, 96400, 190000, 355000, 1090000, 2890000) are employed as standard polyester.

$$5 \leq H1 \leq 70 \quad \text{Equation (1)}$$

$$0.2 \leq H2/H1 \leq 1.0 \quad \text{Equation (2)}$$

H1 is an index of a rate of melting of the first resin contained in a toner layer. In general, since a resin having heat of fusion has sharp-melting capability, it can be molten with less energy. When H1 of the first resin exceeds 70, it is difficult to decrease fixation energy, and hence fixation at a low temperature is difficult. In addition, since adhesiveness of toner particles to a recording medium lowers, document offset is likely. When H1 of the first resin is lower than 5, fixation energy is excessively low and hence document offset is likely. When H1 satisfies Equation (1) above, fixation at a low temperature can be achieved. In addition, since adhesiveness of toner particles to a recording medium is ensured, occurrence of document offset can be prevented. Preferably, relation of $15 \leq H1 \leq 68$ is satisfied and more preferably relation of $35 \leq H1 \leq 65$ is satisfied.

H2/H1 in Equation (2) above is an index of a rate of crystallization of the first resin. In general, in a case where particles made of a resin (resin particles) are used as they are molten and thereafter cooled, if a non-crystallized portion is present in crystal components in the resin particles, such a disadvantage that a resistance value of the resin particles is lowered or the resin particles are plasticized is caused. If such a disadvantage is caused, performance of the resin particles obtained by cooling may be different from performance as originally designed. From the foregoing, it is necessary to quickly crystallize crystal components in the resin particles and to avoid influence on performance of the resin particles. H2/H1 is more preferably not lower than 0.3 and more preferably not lower than 0.4. If a rate of crystallization of the first resin is high, H2/H1 is close to 1.0 and hence H2/H1 preferably takes a value close to 1.0. H2/H1 in Equation (2) above does not exceed 1.0 theoretically, however, a value actually measured with DSC may exceed 1.0. Even a case where a value (H2/H1) actually measured with DSC exceeds 1.0 is also assumed to satisfy Equation (2) above.

A polyester resin is preferably, for example, a polycondensed product of polyol (an alcohol component) and polycarboxylic acid (an acid component), acid anhydride of polycarboxylic acid (an acid component), or ester of lower alkyl of polycarboxylic acid (having a carbon number of an alkyl group from 1 to 4) (an acid component). A known polycondensation catalyst can be used for polycondensation reaction. A ratio between polyol and polycarboxylic acid is not particularly limited.

A ratio between polyol and polycarboxylic acid should only be set such that an equivalent ratio between a hydroxyl group [OH] and a carboxyl group [COOH]([OH]/[COOH]) is set preferably to 2/1 to 1/5, more preferably to 1.5/1 to 1/4, and further preferably to 1.3/1 to 1/3.

Polyol is preferably, for example, diol or polyol having valence not smaller than 3. Diol is preferably, for example, alkylene glycol having a carbon number from 2 to 30 (such as ethylene glycol, 1,2-propylene glycol, 1,3-propylene glycol, 1,4-butanediol, 1,6-hexanediol, octanediol, 1,9-nonanediol, decanediol, 1,10-decanediol, dodecanediol, tetradecanediol, neopentylglycol, or 2,2-diethyl-1,3-propanediol), alkylene ether glycol having Mn=106 to 10000 (such as diethylene glycol, triethylene glycol, dipropylene glycol, polyethylene glycol, polypropylene glycol, or polytetramethylene ether glycol), alicyclic diol having a carbon number from 6 to 24 (such as 1,4-cyclohexanedimethanol or hydrogenated bisphenol A), an adduct (the number of added moles being from 2 to 100) of alkylene oxide (hereinafter "alkylene oxide" being abbreviated as "AO") to alicyclic diol above having Mn=100 to 10000 (such as a 10-mole adduct of 1,4-cyclohexanedimethanol ethylene oxide (hereinafter abbreviated as "EO")), an adduct (the number of added moles being from 2 to 100) of AO [such as EO, propylene oxide (hereinafter abbreviated as "PO"), or butylene oxide] to bisphenols having a carbon number from 15 to 30 (such as bisphenol A, bisphenol F, or bisphenol S), an adduct of AO to polyphenol having a carbon number from 12 to 24 (such as catechol, hydroquinone, or resorcin) (such as a 2 to 4-mole adduct of EO to bisphenol A or a 2 to 4-mole adduct of PO to bisphenol A), polylactonediol having a weight average molecular weight (hereinafter abbreviated as "Mw")=100 to 5000 (such as poly-ϵ-caprolactonediol), polybutadienediol having Mw=1000 to 20000, or the like.

Polyol having valence not smaller than 3 is preferably, for example, aliphatic polyhydric alcohol having valence from 3 to 8 or more and having a carbon number from 3 to 10 (such as glycerol, trimethylolethane, trimethylolpropane, pentaerythritol, sorbitan, or sorbitol), an adduct (the number of added moles being from 2 to 100) of AO (having a carbon number from 2 to 4) to trisphenol having a carbon number from 25 to 50 (such as a 2 to 4-mole adduct of EO to trisphenol or a 2 to 4-mole adduct of PO to trisphenol polyamide), an adduct (the number of added moles being from 2 to 100) of AO (having a carbon number from 2 to 4) to a novolac resin (such as phenol novolac or cresol novolac) having n=3 to 50 (such as a 2-mole adduct of PO to phenol novolac or a 4-mole adduct of EO to phenol novolac), an adduct (the number of added moles being from 2 to 100) of AO (having a carbon number from 2 to 4) to polyphenol having a carbon number from 6 to 30 (such as pyrogallol, phloroglucinol, or 1,2,4-benzenetriol) (such as a 4-mole adduct of EO to pyrogallol), acrylic polyol having n=20 to 2000 {such as a copolymer of hydroxyethyl(meth)acrylate and a monomer having other polymeric double bond [such as styrene, (meth)acrylic acid, or (meth)acrylic acid ester]}, or the like. Among these, as polyol having valence not smaller than 3, aliphatic polyhydric alcohol or an adduct of AO to a novolac resin is preferred, and an adduct of AO to a novolac resin is more preferred.

Polycarboxylic acid is exemplified, for example, by dicarboxylic acid or polycarboxylic acid having valence not smaller than 3. Dicarboxylic acid is preferably, for example, alkane dicarboxylic acid having a carbon number from 4 to 32 (such as succinic acid, adipic acid, sebacic acid, azelaic acid, dodecane dicarboxylic acid, or octadecane dicarboxylic acid), alkene dicarboxylic acid having a carbon number from 4 to 32 (such as maleic acid, fumaric acid, citraconic acid, or mesaconic acid), branched alkene dicarboxylic acid having a carbon number from 8 to 40 [such as dimer acid or alkenyl succinic acid (such as dodecenyl succinic acid, pentadecenyl succinic acid, or octadecenyl succinic acid)], branched alkane dicarboxylic acid having a carbon number from 12 to 40 [such as alkyl succinic acid (such as decyl succinic acid, dodecyl succinic acid, or octadecyl succinic acid)], aromatic dicarboxylic acid having a carbon number from 8 to 20 (such as phthalic acid, isophthalic acid, terephthalic acid, or naphthalene dicarboxylic acid), or the like.

Polycarboxylic acid having valence not smaller than 3 is preferably, for example, aromatic polycarboxylic acid having a carbon number from 9 to 20 (such as trimellitic acid or pyromellitic acid) or the like.

Acid anhydride of polycarboxylic acid is preferably, for example, acid anhydride of dicarboxylic acid, acid anhydride of polycarboxylic acid having valence not smaller than 3, or preferably trimellitic anhydride, pyromellitic anhydride, or the like. Lower alkyl ester of polycarboxylic acid is preferably, for example, lower alkyl ester of dicarboxylic acid, lower alkyl ester of polycarboxylic acid having valence not smaller than 3, or preferably methyl ester, ethyl ester, isopropyl ester, or the like.

A compound containing an isocyanate group is preferably a compound having two or more isocyanate groups in one molecule, and it may be chain aliphatic polyisocyanate or cyclic aliphatic polyisocyanate. Chain aliphatic polyisocyanate is preferably, for example, ethylene diisocyanate, tetramethylene diisocyanate, hexamethylene diisocyanate (hereinafter abbreviated as "HDI"), dodecamethylene diisocyanate, 1,6,11-undecane triisocyanate, 2,2,4-trimethyl hexamethylene diisocyanate, lysine diisocyanate, 2,6-diisocyanatomethyl caproate, bis(2-isocyanatoethyl) fumarate, bis(2-isocyanatoethyl) carbonate, 2-isocyanatoethyl-2,6-diisocyanatohexanoate, or the like. Two or more of these may be used together. Cyclic aliphatic polyisocyanate is preferably, for example, isophoron diisocyanate (hereinafter abbreviated as "IPDI"), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5- or 2,6-norbornane diisocyanate, or the like. Two or more of these may be used together.

A ratio of a constitutional unit derived from an aliphatic monomer occupied in a constitutional unit derived from an acid component and a constitutional unit derived from an alcohol component is preferably not lower than 90 mass %. Since crystallinity of the first resin contained in toner particles is thus higher, fixability of toner particles is improved. In addition, embrittlement of a toner layer formed on a recording medium (the toner layer forming an image) is prevented. Specifically, since an insulating liquid has a flash point not lower than 100° C. in a liquid developer according to the present embodiment, it is low in volatility and tends to remain in a formed toner layer, which may result in lowering in fixability of toner particles. In addition, an insulating liquid which remained in the toner layer may be introduced in between resin molecules in the toner layer to cause embrittleness of the toner layer. If a ratio of a constitutional unit derived from an aliphatic monomer occupied in a constitutional unit derived from an acid component and a constitutional unit derived from an alcohol component is not lower than 90 mass %, however, crystallinity of the first resin contained in toner particles is higher, and hence lowering in fixability of toner particles due to use of an insulating liquid low in volatility can be prevented. When crystallinity of the first resin contained in toner particles is higher, molecules of the first resin are aligned in the formed toner layer. Therefore, since a space between the molecules of the first resin in the toner layer is narrower, introduction of the insulating liquid which remained in the toner layer, in between the molecules of the first resin in the toner layer, can be prevented. Therefore, embrittleness of the toner layer is also prevented. Here, a method of finding a ratio of a constitutional unit derived from an aliphatic monomer occupied in a constitutional unit derived from an acid component and a constitutional unit derived from an alcohol component includes, for example, a method of calculation based on a spectrum obtained from nuclear magnetic resonance or a method of measurement with the use of a GCMS.

Since a polyester resin is preferably a polycondensed product of polyol and polycarboxylic acid as described above, it is preferably a polycondensed product of aliphatic polyol and aliphatic polycarboxylic acid, and more preferably a polycondensed product of aliphatic diol and aliphatic dicarboxylic acid. Aliphatic diol preferably has a straight chain alkyl skeleton having a carbon number not smaller than 4, and for example, preferably it is ethylene glycol, 1,3-propylene glycol, 1,4-butanediol, 1,6-hexanediol, 1,9-nonanediol, or 1,10-decanediol. Aliphatic dicarboxylic acid is preferably, for example, alkane dicarboxylic acid having a carbon number from 4 to 20, alkene dicarboxylic acid having a carbon number from 4 to 36, or an ester-forming derivative thereof. Succinic acid, adipic acid, sebacic acid, maleic acid, or fumaric acid, or an ester-forming derivative thereof is more preferred as aliphatic dicarboxylic acid.

Depending on applications of a liquid developer, a number average molecular weight (Mn), a melting point, Tg, and an SP value of the first resin are preferably adjusted as appropriate. For example, in a case that the liquid developer according to the present embodiment is used as a liquid developer used for electrophotography, electrostatic recording, or electrostatic printing, the first resin has Mn preferably from 5000 to 50000, a melting point preferably from 30 to 80° C., and Tg preferably not lower than 40° C. and more preferably not higher than 80° C. When the first resin has Tg not higher than 80° C., fixation at a low temperature can be achieved.

Mn of the first resin can be measured under conditions below, with the use of gel permeation chromatography (GPC).

Measurement Apparatus: "HLC-8120" manufactured by Tosoh Corporation

Column: "TSKGEL GMHXL" (two) manufactured by Tosoh Corporation and—"TSKGEL MULTIPORE HXL-M" (one) manufactured by Tosoh Corporation Sample Solution: 0.25 mass % of THF solution Amount of Injection of Sample Solution into Column: 100 μl Flow Rate: 1 ml/min.

Measurement Temperature: 40° C.

Detection Apparatus: Refraction index detector

Reference Material: 12 standard polystyrenes manufactured by Tosoh Corporation (TSK standard POLYSTYRENE) (molecular weight: 500, 1050, 2800, 5970, 9100, 18100, 37900, 96400, 190000, 355000, 1090000, 2890000)

A melting point of the first resin can be measured with the use of a DSC apparatus (such as DSC20 or SSC/580 manufactured by Seiko Instruments, Inc.) in compliance with a method defined under ASTM D3418-82.

Tg of the first resin can be measured with a DSC method or also with a flow tester. In a case where Tg is measured with the DSC method, for example, Tg can be measured with the DSC apparatus above in compliance with the method defined under ASTM D3418-82. In a case where Tg is measured with a flow tester, a flow tester (capillary rheometer) (such as a CFT-500 type manufactured by Shimadzu Corporation) can be employed for measurement under conditions shown below.

Load: 3 MPa

Rate of Temperature Increase: 3.0° C./min.

Die Diameter: 0.50 mm

Die Length: 10.0 mm

The resin contained in toner particles may contain 20 mass % or less of a resin different from the first resin (hereinafter denoted as a "second resin"). The second resin is not particularly limited, and it is preferably a vinyl resin, a polyurethane resin, an epoxy resin, a polyamide resin, a polyimide resin, a silicon resin, a phenol resin, a melamine resin, a urea resin, an aniline resin, an ionomer resin, or a polycarbonate resin, and it is more preferably a vinyl resin.

The vinyl resin may be a homopolymer obtained by homopolymerizing a monomer having polymeric double bond or a copolymer obtained by copolymerizing two or more types of monomers having polymeric double bond. A monomer having polymeric double bond is, for example, (1) to (9) below.

(1) Hydrocarbon Having Polymeric Double Bond

Hydrocarbon having polymeric double bond is preferably, for example, aliphatic hydrocarbon having polymeric double bond shown in (1-1) below, aromatic hydrocarbon having polymeric double bond shown in (1-2) below, or the like.

(1-1) Aliphatic Hydrocarbon Having Polymeric Double Bond

Aliphatic hydrocarbon having polymeric double bond is preferably, for example, chain hydrocarbon having polymeric double bond shown in (1-1-1) below, cyclic hydrocarbon having polymeric double bond shown in (1-1-2) below, or the like.

(1-1-1) Chain Hydrocarbon Having Polymeric Double Bond

Chain hydrocarbon having polymeric double bond is preferably, for example, alkene having a carbon number from 2 to 30 (such as ethylene, propylene, butene, isobutylene, pentene, heptene, diisobutylene, octene, dodecene, or octadecene), alkadiene having a carbon number from 4 to 30 (such as butadiene, isoprene, 1,4-pentadiene, 1,5-hexadiene, or 1,7-octadiene), or the like.

(1-1-2) Cyclic Hydrocarbon Having Polymeric Double Bond

Cyclic hydrocarbon having polymeric double bond is preferably, for example, mono- or di-cycloalkene having a carbon number from 6 to 30 (such as cyclohexene, vinyl cyclohexene, or ethylidene bicycloheptene), mono- or di-cycloalkadiene having a carbon number from 5 to 30 (such as cyclopentadiene or dicyclopentadiene), or the like.

(1-2) Aromatic Hydrocarbon Having Polymeric Double Bond

Aromatic hydrocarbon having polymeric double bond is preferably, for example, styrene, hydrocarbyl (such as alkyl, cycloalkyl, aralkyl, and/or alkenyl having a carbon number from 1 to 30) substitute of styrene (such as ca-methylstyrene, vinyl toluene, 2,4-dimethylstyrene, ethylstyrene, isopropylstyrene, butylstyrene, phenylstyrene, cyclohexylstyrene, benzylstyrene, crotylbenzene, divinyl benzene, divinyl toluene, divinyl xylene, or trivinyl benzene), or vinyl naphthalene.

(2) Monomer Having Carboxyl Group and Polymeric Double Bond and Salt Thereof

A monomer having a carboxyl group and polymeric double bond is preferably, for example, unsaturated monocarboxylic acid having a carbon number from 3 to 15 [such as (meth) acrylic acid, crotonic acid, isocrotonic acid, or cinnamic acid], unsaturated dicarboxylic acid (unsaturated dicarboxylic anhydride) having a carbon number from 3 to 30 [such as maleic acid (maleic anhydride), fumaric acid, itaconic acid, citraconic acid (citraconic anhydride), or mesaconic acid], monoalkyl (having a carbon number from 1 to 10) ester of unsaturated dicarboxylic acid having a carbon number from 3 to 10 (such as maleic acid monomethyl ester, maleic acid monodecyl ester, fumaric acid monoethyl ester, itaconic acid monobutyl ester, or citraconic acid monodecyl ester), or the like. "(Meth)acrylic acid" herein means acrylic acid and/or methacrylic acid.

Salt of the monomer above is preferably, for example, alkali metal salt (such as sodium salt or potassium salt), alkaline earth metal salt (such as calcium salt or magnesium salt), ammonium salt, amine salt, quaternary ammonium salt, or the like.

Amine salt is not particularly limited so long as it is an amine compound. Amine salt is preferably, for example, primary amine salt (such as ethylamine salt, butylamine salt, or octylamine salt), secondary amine salt (such as diethylamine salt or dibutylamine salt), tertiary amine salt (such as triethylamine salt or tributylamine salt), or the like.

Quaternary ammonium salt is preferably, for example, tetraethyl ammonium salt, triethyl lauryl ammonium salt, tetrabutyl ammonium salt, tributyl lauryl ammonium salt, or the like.

Salt of the monomer having a carboxyl group and polymeric double bond is preferably, for example, sodium acrylate, sodium methacrylate, monosodium maleate, disodium maleate, potassium acrylate, potassium methacrylate, monopotassium maleate, lithium acrylate, cesium acrylate, ammonium acrylate, calcium acrylate, aluminum acrylate, or the like.

(3) Monomer Having Sulfo Group and Polymeric Double Bond and Salt Thereof

A monomer having a sulfo group and polymeric double bond is preferably, for example, vinyl sulfonic acid, α-methylstyrene sulfonic acid, sulfopropyl(meth)acrylate, or 2-(meth)acryloylamino-2,2-dimethylethane sulfonic acid. Salt of a monomer having a sulfo group and polymeric double bond is preferably, for example, salts listed as the "salt of the monomer above" in "(2) Monomer Having Carboxyl Group and Polymeric Double Bond" above.

(4) Monomer Having Phosphono Group and Polymeric Double Bond and Salt Thereof

A monomer having a phosphono group and polymeric double bond is preferably, for example, 2-hydroxyethyl (meth)acryloyl phosphate or 2-acryloyloxy ethyl phosphonic acid. Salt of the monomer having a phosphono group and polymeric double bond is preferably, for example, salts listed as the "salt of the monomer above" in "(2) Monomer Having Carboxyl Group and Polymeric Double Bond" above.

(5) Monomer Having Hydroxyl Group and Polymeric Double Bond

A monomer having a hydroxyl group and polymeric double bond is preferably, for example, hydroxystyrene, N-methylol(meth)acrylamide, or hydroxyethyl(meth)acrylate.

(6) Nitrogen-Containing Monomer Having Polymeric Double Bond

A nitrogen-containing monomer having polymeric double bond is preferably, for example, a monomer shown in (6-1) to (6-4) below.

(6-1) Monomer Having Amino Group and Polymeric Double Bond

A monomer having an amino group and polymeric double bond is preferably, for example, aminoethyl(meth)acrylate, dimethylaminoethyl(meth)acrylate, diethylaminoethyl (meth)acrylate, t-butylaminoethyl methacrylate, N-aminoethyl(meth)acrylamide, (meth)allyl amine, morpholinoethyl (meth)acrylate, 4-vinylpyridine, 2-vinylpyridine, crotyl amine, N,N-dimethylamino styrene, methyl-α-acetamino acrylate, vinylimidazole, N-vinylpyrrole, N-vinyl thiopyrrolidone, N-aryl phenylenediamine, aminocarbazole, aminothiazole, aminoindole, aminopyrrole, aminoimidazole, aminomercaptothiazole, or the like. The monomer having an amino group and polymeric double bond may be the salts of the monomer listed above. The salts of the monomer listed above are preferably, for example, salts listed as the "salt of the monomer above" in "(2) Monomer Having Carboxyl Group and Polymeric Double Bond" above.

(6-2) Monomer Having Amide Group and Polymeric Double Bond

A monomer having an amide group and polymeric double bond is preferably, for example, (meth)acrylamide, N-methyl (meth)acrylamide, N-butyl acrylamide, diacetone acrylamide, N-methylol(meth)acrylamide, N,N'-methylene-bis (meth)acrylamide, cinnamic acid amide, N,N-dimethylacrylamide, N,N-dibenzyl(meth)acrylamide, (meth)acrylformamide, N-methyl-N-vinylacetamide, N-vinylpyrrolidone, or the like.

(6-3) Monomer Having Carbon Number from 3 to 10 and Having Nitrile Group and Polymeric Double Bond A monomer having a carbon number from 3 to 10 and having a nitrile group and polymeric double bond is preferably, for example, (meth)acrylonitrile, cyanostyrene, cyanoacrylate, or the like.

(6-4) Monomer Having Carbon Number from 8 to 12 and Having Nitro Group and Polymeric Double Bond A monomer having a carbon number from 8 to 12 and having a nitro group and polymeric double bond is preferably, for example, nitrostyrene or the like.

(7) Monomer Having Carbon Number from 6 to 18 and Having Epoxy Group and Polymeric Double Bond A monomer having a carbon number from 6 to 18 and having an epoxy group and polymeric double bond is preferably, for example, glycidyl(meth)acrylate or the like.

(8) Monomer Having Carbon Number from 2 to 16 and Having Halogen Element and Polymeric Double Bond A monomer having a carbon number from 2 to 16 and having a halogen element and polymeric double bond is preferably, for example, vinyl chloride, vinyl bromide, vinylidene chloride, allyl chloride, chlorostyrene, bromostyrene, dichlorostyrene, chloromethylstyrene, tetrafluorostyrene, chloroprene, or the like.

(9) Others

Other than the monomers above, a monomer having polymeric double bond may be a monomer shown in (9-1) to (9-4) below.

(9-1) Ester Having Carbon Number from 4 to 16 and Having Polymeric Double Bond

An ester having a carbon number from 4 to 16 and having polymeric double bond is preferably, for example, vinyl acetate, vinyl propionate, vinyl butyrate, diallyl phthalate, diallyl adipate, isopropenyl acetate, vinyl methacrylate, methyl-4-vinyl benzoate, cyclohexyl methacrylate, benzyl methacrylate, phenyl(meth)acrylate, vinyl methoxy acetate, vinyl benzoate, ethyl-α-ethoxy acrylate, alkyl(meth)acrylate having an alkyl group having a carbon number from 1 to 11 [such as methyl(meth)acrylate, ethyl(meth)acrylate, propyl (meth)acrylate, butyl(meth)acrylate, or 2-ethylhexyl(meth) acrylate], dialkyl fumarate (two alkyl groups being straight-chain alkyl groups, branched alkyl groups, or alicyclic alkyl groups, having a carbon number from 2 to 8), dialkyl maleate (two alkyl groups being straight-chain alkyl groups, branched alkyl groups, or alicyclic alkyl groups, having a carbon number from 2 to 8), poly(meth)allyloxy alkanes (such as diallyloxyethane, triallyloxyethane, tetraallyloxyethane, tetraallyloxypropane, tetraallyloxybutane, or tetramethallyloxyethane), a monomer having a polyalkylene glycol chain and polymeric double bond [such as polyethylene glycol (Mn=300) mono(meth)acrylate, polypropylene glycol (Mn=500) mono(meth)acrylate, a 10-mole adduct (meth)acrylate of EO to methyl alcohol, or a 30-mole adduct (meth)acrylate of EO to lauryl alcohol], poly(meth)acrylates {such as poly(meth)acrylate of polyhydric alcohols [such as ethylene glycol di(meth)acrylate, propylene glycol di(meth) acrylate, neopentyl glycol di(meth)acrylate, trimethylol propane tri(meth)acrylate, or polyethylene glycol di(meth)acrylate]}, or the like.

(9-2) Ether Having Carbon Number from 3 to 16 and Having Polymeric Double Bond

Ether having a carbon number from 3 to 16 and having polymeric double bond is preferably, for example, vinyl methyl ether, vinyl ethyl ether, vinyl propyl ether, vinyl butyl ether, vinyl-2-ethyl hexyl ether, vinyl phenyl ether, vinyl-2-methoxy ethyl ether, methoxy butadiene, vinyl-2-butoxyethyl ether, 3,4-dihydro-1,2-pyran, 2-butoxy-2'-vinyloxy diethyl ether, acetoxystyrene, phenoxystyrene, or the like.

(9-3) Ketone Having Carbon Number from 4 to 12 and Having Polymeric Double Bond

Ketone having a carbon number from 4 to 12 and having polymeric double bond is preferably, for example, vinyl methyl ketone, vinyl ethyl ketone, vinyl phenyl ketone, or the like.

(9-4) Sulfur Containing Compound Having Carbon Number from 2 to 16 and Having Polymeric Double Bond A sulfur containing compound having a carbon number from 2 to 16 and having polymeric double bond is preferably, for example, divinyl sulfide, p-vinyl diphenyl sulfide, vinyl ethyl sulfide, vinyl ethyl sulfone, divinyl sulfone, divinylsulfoxide, or the like.

A specific example of a vinyl resin is preferably, for example, a styrene-(meth)acrylic acid ester copolymer, a styrene-butadiene copolymer, a (meth)acrylic acid-(meth) acrylic acid ester copolymer, a styrene-acrylonitrile copolymer, a styrene-maleic acid (maleic anhydride) copolymer, a styrene-(meth)acrylic acid copolymer, a styrene-(meth) acrylic acid-divinylbenzene copolymer, a styrene-styrene sulfonic acid-(meth)acrylic acid ester copolymer, or the like.

The vinyl resin may be a homopolymer or a copolymer of a monomer having polymeric double bond in (1) to (9) above, or it may be a polymerized product of a monomer having polymeric double bond in (1) to (9) above and a monomer (m) having a molecular chain (k) and having polymeric double bond. The molecular chain (k) is preferably, for example, a straight-chain or branched hydrocarbon chain having a carbon number from 12 to 27, a fluoro-alkyl chain having a carbon number from 4 to 20, a polydimethylsiloxane chain, or the like. A difference in SP value between the molecular chain (k) in the monomer (m) and the insulating liquid is preferably 2 or smaller. The "SP value" herein is a numeric value calculated with a Fedors' method [Polym. Eng. Sci. 14(2) 152, (1974)].

Though the monomer (m) having the molecular chain (k) and polymeric double bond is not particularly limited, it is preferably, for example, monomers (m1) to (m4) below. Two or more of the monomers (m1) to (m4) may be used together.

Monomer (m1) having straight-chain hydrocarbon chain having carbon number from 12 to 27 (preferably from 16 to 25) and polymeric double bond is preferably, for example, mono-straight-chain alkyl (a carbon number of alkyl being from 12 to 27) ester of unsaturated monocarboxylic acid, mono-straight-chain alkyl (a carbon number of alkyl being from 12 to 27) ester of unsaturated dicarboxylic acid, or the like. Unsaturated monocarboxylic acid and unsaturated dicarboxylic acid above are preferably, for example, a carboxyl group containing vinyl monomer having a carbon number from 3 to 24 such as (meth)acrylic acid, maleic acid, fumaric acid, crotonic acid, itaconic acid, and citraconic acid. A specific example of the monomer (m1) is, for example, dodecyl (meth)acrylate, stearyl(meth)acrylate, behenyl(meth)acrylate, hexadecyl(meth)acrylate, heptadecyl(meth)acrylate, eicosyl(meth)acrylate, or the like.

Monomer (m2) having branched hydrocarbon chain having carbon number from 12 to 27 (preferably from 16 to 25) and polymeric double bond is preferably, for example, branched alkyl (a carbon number of alkyl being from 12 to 27) ester of unsaturated monocarboxylic acid, mono-branched alkyl (a carbon number of alkyl being from 12 to 27) ester of unsaturated dicarboxylic acid, or the like. Unsaturated monocarboxylic acid and unsaturated dicarboxylic acid are preferably, for example, as listed as specific examples of unsaturated monocarboxylic acid and unsaturated dicarboxylic acid with regard to the monomer (m1). A specific example of the monomer (m2) is, for example, 2-decyltetradecyl(meth)acrylate or the like.

Monomer (m3) having fluoro-alkyl chain having carbon number from 4 to 20 and polymeric double bond is, for example, perfluoroalkyl(alkyl)(meth)acrylic acid ester or the like expressed with a Formula (3) below. In Formula (3) below, R represents a hydrogen atom or a methyl group, p represents an integer from 0 to 3, q represents any of 2, 4, 6, 8, 10, and 12, and Z represents a hydrogen atom or a fluorine atom. A specific example of the monomer (m3) is preferably, for example, [(2-perfluoroethyl)ethyl](meth)acrylic acid ester, [(2-perfluorobutyl)ethyl](meth)acrylic acid ester, [(2-perfluorohexyl)ethyl](meth)acrylic acid ester, [(2-perfluorooctyl)ethyl](meth)acrylic acid ester, [(2-perfluorodecyl)ethyl](meth)acrylic acid ester, [(2-perfluorododecyl)ethyl](meth)acrylic acid ester, or the like.

$$CH_2{=}CR{-}COO{-}(CH_2)_p{-}(CF_3)_q{-}Z \qquad \text{Formula (3)}$$

Monomer (m4) having polydimethylsiloxane chain and polymeric double bond is, for example, (meth)acrylic modified silicone or the like expressed with a Formula (4) below. In Formula (4) below, R represents a hydrogen atom or a methyl group and m is from 15 to 45 on average. A specific example of the monomer (m4) is preferably, for example, modified silicone oil (such as "X-22-174DX", "X-22-2426", or "X-22-2475" manufactured by Shin-Etsu Chemical Co., Ltd.) or the like.

$$CH_2{=}CR{-}COO{-}((CH_3)_2SiO)_m{-}Si(CH_3)_3 \qquad \text{Formula (4)}$$

Among the monomers (m1) to (m4), a preferred monomer is the monomer (m1) and the monomer (m2) and a more preferred monomer is the monomer (m2).

A content of the monomer (m) is preferably from 10 to 90 mass %, more preferably from 15 to 80 mass %, and further preferably from 20 to 60 mass %, with respect to a mass of the vinyl resin. So long as the content of the monomer (m) is within the range above, toner particles are less likely to unite with each other.

In a case where a monomer having polymeric double bond in (1) to (9) above, the monomer (m1), and the monomer (m2) are polymerized to make up a vinyl resin, from a point of view of particle size distribution of toner particles and fixability of the toner particles, a mass ratio between the monomer (m1) and the monomer (m2) [(m1):(m2)] is preferably from 90:10 to 10:90, more preferably from 80:20 to 20:80, and further preferably from 70:30 to 30:70.

The second resin preferably has physical properties shown below. Mn of the second resin is preferably from 100 to 5000000, preferably from 200 to 5000000, and further preferably from 500 to 500000. Mn of the second resin can be measured in accordance with a method the same as that for Mn of the first resin.

<Additive>

The toner particles in the present embodiment preferably contain a coloring agent as an additive, and more preferably they further contain also a dispersant for pigment, a filler, an antistatic agent, a release agent, a charge control agent, a UV absorber, an antioxidant, an antiblocking agent, a heat-resistant stabilization agent, or a fire retardant.

<Coloring Agent>

Though a known pigment can be employed as a coloring agent without being particularly limited, from a point of view of cost, light resistance, coloring capability, and the like, pigments shown below are preferably employed. In terms of color construction, pigments shown below are normally categorized into a black pigment, a yellow pigment, a magenta pigment, and a cyan pigment, and colors (color images) other than black are basically toned by subtractive color mixture of a yellow pigment, a magenta pigment, and a cyan pigment. The pigment may be obtained by subjecting a pigment shown below to surface treatment with the use of a solvent which is acidic, basic, or the like. For example, an acidic or basic synergist may be used together with pigments shown below.

A black pigment is preferably, for example, carbon black such as furnace black, channel black, acetylene black, thermal black, or lamp black, carbon black derived from biomass, or magnetic powders of magnetite or ferrite.

A yellow pigment is preferably, for example, a disazo based yellow pigment such as C. I. (color index) Pigment Yellow 12, 13, 14, 17, 55, 81, 83, 180, or 185, or the like.

A magenta pigment is preferably, for example, an azo lake based magenta pigment such as C. I. Pigment Red 48, 57 (carmine 6B), 5, 23, 60, 114, 146, or 186, an insoluble azo based magenta pigment, a thioindigo based magenta pigment such as C. I. Pigment Red 88, C. I. Pigment Violet 36, or C. I. Pigment Violet 38, a quinacridone based magenta pigment such as C. I. Pigment Red 122 or 209, a naphtol based magenta pigment such as C. I. Pigment Red 269, or the like. As a magenta pigment, at least one of a quinacridone based pigment, a carmine based pigment, and a naphtol based pigment is preferably contained among these, and more preferably, two or three types of these three types of pigments are contained.

A cyan pigment is preferably, for example, a copper phthalocyanine blue based cyan pigment such as C. I. Pigment Blue 15:1 or 15:3, a phthalocyanine green based pigment, or the like.

Such a pigment is preferably dispersed in a resin contained in toner particles, and a particle size thereof is preferably not larger than 0.3 μm. When a pigment has a particle size exceeding 0.3 μm, dispersion of the pigment becomes poor, which results in lowering in degree of gloss. Consequently, it may be difficult to realize a desired color.

An amount of addition of a pigment is preferably not lower than 10 mass % and lower than 50 mass % and more preferably not lower than 13 mass % and lower than 35 mass % with respect to the total solid content of the liquid developer. When an amount of addition of a pigment is lower than 10 mass % with respect to the total solid content of the liquid developer, sufficient coloring capability cannot be obtained in some cases. In addition, liquefaction of the resin cannot be prevented by addition of the pigment in some cases. Specifically, as a degree of crystallinity of the resin contained in the toner particles is higher, that resin is molten at a low temperature and tends to readily be liquefied. Addition of an appropriate amount of pigment, however, prevents liquefaction owing to a filler effect. When an amount of addition of the pigment exceeds 50 mass % with respect to the total solid content of the liquid developer, the filler effect above is excessive and it may be difficult to melt the resin. The liquid developer according to the present embodiment may contain only one type of the pigments above or may contain two or more types of the pigments above.

<Dispersant for Pigment>

A dispersant for pigment has a function to uniformly disperse a pigment in toner particles and it is preferably, for example, a basic dispersant. Here, the basic dispersant refers to a dispersant defined below. Namely, 0.5 g of a dispersant for pigment and 20 ml of distilled water are introduced in a screw bottle made of glass, the screw bottle is shaken for 30 minutes with the use of a paint shaker, and the resultant product is filtered. pH of a filtrate obtained through filtration is measured with a pH meter (D-51 of Horiba, Ltd.), and a filtrate of which pH is higher than 7 is defined as a basic dispersant. It is noted that a filtrate obtained by filtration, of which pH is lower than 7, is referred to as an acid dispersant.

A type of such a basic dispersant is not particularly limited. For example, a compound (dispersant) having a functional group such as an amino group, an amide group, a pyrrolidone group, an imine group, or a urethane group in a molecule of the dispersant can be exemplified. It is noted that what is called a surfactant having a hydrophilic portion and a hydrophobic portion in a molecule normally falls under the dispersant. Not only the surfactant but also various compounds, however, can be employed as the dispersant, so long as they have a function to disperse a pigment.

A commercially available product of such a basic dispersant is preferably, for example, "AJISPER PB-821" (trade name), "AJISPER PB-822" (trade name), or "AJISPER PB-881" (trade name), manufactured by Ajinomoto Fine-Techno Co., Inc., or "SOLSPERSE 28000" (trade name), "SOLSPERSE 32000" (trade name), "SOLSPERSE 32500" (trade name), "SOLSPERSE 35100" (trade name), or "SOLSPERSE 37500" (trade name), manufactured by Japan Lubrizol Limited.

More preferably, a dispersant for pigment is not dissolved in an insulating liquid, and for example, "AJISPER PB-821" (trade name), "AJISPER PB-822" (trade name), or "AJISPER PB-881" (trade name), manufactured by Ajinomoto Fine-Techno Co., Inc. is more preferred. By using such a dispersant for pigment, it became easier to obtain toner particles having a desired shape, although a reason is not known.

Preferably 1 to 100 mass % and more preferably 1 to 40 mass % of such a dispersant for pigment is added to the pigment. When an amount of addition of the dispersant for pigment is lower than 1 mass %, dispersibility of the pigment may be insufficient, and hence necessary ID (image density) cannot be achieved in some cases. In addition, fixability of toner particles may be lowered. When an amount of addition of the dispersant for pigment exceeds 100 mass %, the dispersant for pigment in an amount more than necessary for dispersing the pigment is added. Therefore, the excessive dispersant for pigment may be dissolved in the insulating liquid, which adversely affects chargeability or fixability of toner particles. One type alone of such a dispersant for pigment may be used or two or more types may be mixed for use.

Toner particles have been described above. Toner particles preferably have a core-shell structure (Japanese Laid-Open Patent Publication No. 2009-96994). The core-shell structure includes not only such a structure that shell particles (containing the second resin) cover at least a part of surfaces of core particles (containing the first resin) but also such a structure that shell particles adhere to at least a part of surfaces of core particles. A coloring agent or a dispersant for pigment may be contained in core particles or shell particles or may be contained in both of core particles and shell particles.

In a case that toner particles have the core-shell structure, a mass ratio between the shell particles and the core particles (shell particles:core particles) is preferably from 1:99 to 70:30. From a point of view of uniformity in particle size of toner particles, heat-resistance stability of the liquid developer, and the like, the mass ratio (shell particles:core particles) above is more preferably from 2:98 to 50:50 and further preferably from 3:97 to 35:65. When a content (a mass ratio) of the shell particles is too low, blocking resistance of the toner particles may lower. When a content (a mass ratio) of the core particles is too high, uniformity in particle size of the toner particles may lower.

From a point of view of particle size distribution of the toner particles and heat-resistance stability of the liquid developer, the toner particles are preferably composed of 1 to 70 mass % (more preferably 5 to 50 mass % and further preferably 10 to 35 mass %) of the shell particles in a film shape and 30 to 99 mass % (more preferably 50 to 95 mass % and further preferably 65 to 90 mass %) of the core particles, with respect to a mass of the toner particles.

Shell particles in the core-shell structure can be manufactured with a method shown in any of [1] to [7] below. From a point of view of ease in manufacturing of the shell particles, manufacturing with a method shown in [4], [6], or [7] below is preferred, and manufacturing with a method shown in [6] or [7] below is more preferred.

[1]: The second resin is crushed with a dry method with the use of a known dry type crusher such as a jet mill.

[2]: Powders of the second resin are dispersed in an organic solvent, and the resultant product is crushed with a wet method with the use of a known wet type disperser such as a bead mill or a roll mill.

[3]: A solution of the second resin is sprayed and dried with the use of a spray dryer or the like.

[4]: A poor solvent is added to a solution of the second resin or the solution is cooled, to thereby supersaturate and precipitate the second resin.

[5]: A solution of the second resin is dispersed in water or an organic solvent.

[6]: A precursor of the second resin is polymerized in water with an emulsion polymerization method, a soap-free emulsion polymerization method, a seed polymerization method, a suspension polymerization method, or the like.

[7]: A precursor of the second resin is polymerized in an organic solvent through dispersion polymerization or the like.

A volume average particle size of the shell particles can be adjusted as appropriate in order to achieve a particle size suited to obtain toner particles having a desired particle size. A volume average particle size of the shell particles is preferably from 0.0005 to 3 μm. The upper limit of the volume average particle size of the shell particles is more preferably 2 μm and further preferably 1 μm. The lower limit of the volume average particle size of the shell particles is more preferably 0.01 μm, further preferably 0.02 μm, and most preferably 0.04 μm. For example, in a case where toner particles having a volume average particle size of 1 μm are desirably obtained, the shell particles have a volume average particle size preferably from 0.0005 to 0.3 μm and more preferably from 0.001 to 0.2 μm. For example, in a case where toner particles having a volume average particle size of 10 μm are desirably obtained, the shell particles have a volume average particle size preferably from 0.005 to 3 μm and more preferably from 0.05 to 2 μm.

The volume average particle size can be measured by using, for example, a laser diffraction/scattering particle size distribution analyzer (such as "LA-920" manufactured by Horiba, Ltd. or "MULTISIZER III" manufactured by Beckman Coulter or "ELS-800" (manufactured by Otsuka Electronics Co., Ltd.) using a laser Doppler method as an optical system or the like). If different measurement apparatuses measure a volume average particle size and there is variation in measurement values, a measurement value obtained by "ELS-800" is adopted.

In a case that toner particles have the core-shell structure, the second resin forming the shell particles has an SP value preferably from 7 to 18 $(cal/cm^3)^{1/2}$ and more preferably from 8 to 14 $(cal/cm^3)^{1/2}$. Mn of the second resin forming the shell particles is preferably from 100 to 5000000, more preferably from 200 to 5000000, and further preferably from 500 to 500000. The second resin forming the shell particles has a melting point preferably from 0 to 220° C., more preferably from 30 to 200° C., and further preferably from 40 to 80° C. From a point of view of particle size distribution of toner particles, as well as powder fluidity, heat-resistant storage stability, and resistance to stress of the liquid developer, the second resin has a melting point preferably not lower than a temperature during manufacturing of the liquid developer. If a melting point of the second resin is lower than a temperature during manufacturing of the liquid developer, it may be difficult to prevent toner particles from uniting with each other and it may be difficult to prevent the toner particles from breaking. In addition, it may be difficult to achieve a narrow width of distribution in particle size distribution of the toner particles. In other words, variation in particle size of toner particles may be great. Mn and a melting point of the second resin can be measured with methods the same as the methods for measuring Mn and a melting point of the first resin.

<Method of Manufacturing Liquid Developer>

The liquid developer according to the present embodiment is preferably manufactured by dispersing toner particles in an insulating liquid. Toner particles are preferably manufactured in accordance with a method shown below.

<Method of Manufacturing Toner Particles>

Toner particles are preferably manufactured based on such a known technique as a crushing method or a granulation method. In the crushing method, resin particles and a pigment are mixed and kneaded, and then the mixture is crushed. Crushing is preferably carried out in a dry state or a wet state such as in oil.

The granulation method is exemplified, for example, by a suspension polymerization method, an emulsion polymerization method, a fine particle aggregation method, a method of adding a poor solvent to a resin solution for precipitation, a spray drying method, or a method of forming a core-shell structure with two different types of resins.

In order to obtain toner particles having a small diameter and sharp particle size distribution, the granulation method rather than the crushing method is preferably employed. Toner particles high in meltability or toner particles high in crystallinity are soft even at a room temperature and less likely to be crushed. Therefore, with the granulation method, a desired toner particle size is obtained more easily than with the crushing method. Among the granulation methods, toner particles are preferably manufactured with a method shown below.

Initially, a core resin solution is obtained by dissolving a resin in a good solvent. Then, the core resin solution described above is mixed, together with an interfacial tension adjuster, in a poor solvent different in SP value from the good solvent, shear is provided, and thus a droplet is formed. Thereafter, by volatilizing the good solvent, core resin particles are obtained. A surfactant or a dispersant can be employed as the interfacial tension adjuster. Suitable means for obtaining toner particles having a small diameter and sharp particle size distribution includes a method of using fine particles made of a shell resin as an interfacial tension adjuster and forming a film of the shell resin on a surface of a core resin. With this method, controllability of a particle size or a shape of toner particles based on variation in how to provide shear or variation in difference in interfacial tension or interfacial tension adjuster (a material for the shell resin) is high. Therefore, toner particles having desired particle size distribution are likely to be obtained.

A construction of an apparatus for forming an image (image forming apparatus) which is formed by a liquid developer according to the present embodiment is not particularly limited. An image forming apparatus is preferably, for example, a monochrome image forming apparatus in which a monochrome liquid developer is primarily transferred from a photoconductor to an intermediate transfer element and thereafter secondarily transferred to paper (see FIG. 1), an image forming apparatus in which a monochrome liquid developer is directly transferred from a photoconductor to paper, or a multi-color image forming apparatus forming a color image by layering a plurality of types of liquid developers.

EXAMPLES

Though the present invention will be described hereinafter in further detail with reference to Examples, the present invention is not limited thereto.

Manufacturing Example 1

Manufacturing of Polyester Resin

In a reaction vessel provided with a stirrer, a heating and cooling apparatus, a thermometer, a cooling pipe, and a nitrogen introduction pipe, 286 parts by mass of dodecane dicarboxylic acid, 190 parts by mass of 1,6-hexanediol, and 1 part by mass of titanium dihydroxybis(triethanolaminate) as a condensation catalyst were introduced. These were caused to react for 8 hours under a nitrogen current at 180° C. while generated water was distilled out. Then, while a temperature was gradually raised to 220° C. and generated water was distilled out, they were caused to react for 4 hours under a nitrogen current. In addition, they were caused to react for 1 hour at a reduced pressure from 0.007 to 0.026 MPa. Thus, a polyester resin was obtained.

A melting point of the polyester resin was measured with the use of a differential scanning calorimetry apparatus ("DSC20" manufactured by Seiko Instruments, Inc.) in compliance with a method defined under ASTM D3418-82, and it was 68° C.

Mn and Mw of the resultant polyester resin were measured under conditions below. Mn was 4900 and Mw was 10000.

Measurement Apparatus: "HLC-8120" manufactured by Tosoh Corporation

Column: "TSKGEL GMHXL" (two) manufactured by Tosoh Corporation and "TSKGEL MULTIPORE HXL-M" (one) manufactured by Tosoh Corporation Sample Solution: 0.25 mass % of THF solution Amount of Injection of THF Solution into Column: 100 μl Flow Rate: 1 ml/min.

Measurement Temperature: 40° C.

Detection Apparatus: Refraction index detector

Reference Material: 12 standard polystyrenes manufactured by Tosoh Corporation (TSK standard POLYSTYRENE) (molecular weight: 500, 1050, 2800, 5970, 9100, 18100, 37900, 96400, 190000, 355000, 1090000, 2890000)

Manufacturing Example 2

Manufacturing of Dispersion Liquid (W1) of Shell Particles (A1)

In a beaker made of glass, 80 parts by mass of 2-decyltetradecyl(meth)acrylate, 5 parts by mass of methyl methacrylate, 5 parts by mass of methacrylic acid, 20 parts by mass of an equimolar reactant with an isocyanate group containing monomer ("KARENZ MOI" [manufactured by Showa Denko K.K.) and the polyester resin obtained in Manufacturing Example 1 above, and 0.5 part by mass of azobis methoxy dimethyl valeronitrile were introduced, and stirred and mixed at 20° C. Thus, a monomer solution was obtained.

Then, a reaction vessel provided with a stirrer, a heating and cooling apparatus, a thermometer, a dropping funnel, a desolventizer, and a nitrogen introduction pipe was prepared. In that reaction vessel, 195 parts by mass of THF were introduced, and the monomer solution above was introduced in the dropping funnel provided in the reaction vessel. After a vapor phase portion of the reaction vessel was replaced with nitrogen, the monomer solution was dropped in THF in the reaction vessel for 1 hour at 70° C. in a sealed condition. Three hours after the end of dropping of the monomer solution, a mixture of 0.05 part by mass of azobis methoxy dimethyl valeronitrile and 5 parts by mass of THF was introduced in the reaction vessel and caused to react for 3 hours at 70° C. Thereafter, cooling to room temperature was carried out. Thus, a copolymer solution was obtained.

Four hundred parts by mass of the obtained copolymer solution were dropped in 600 parts by mass of IP SOLVENT 2028 (manufactured by Idemitsu Kosan Co., Ltd.) which was being stirred, and THF was distilled out at 40° C. at a reduced pressure of 0.039 MPa. Thus, a dispersion liquid (W1) of shell particles (A1) was obtained. A volume average particle size of the shell particles (A1) in the dispersion liquid (W1) was measured with a laser particle size distribution analyzer ("LA-920" manufactured by Horiba, Ltd.), which was 0.13 μm.

Manufacturing Example 3

Manufacturing of Solution (Y1) for Forming Core Resin (b1)

In a reaction vessel provided with a stirrer, a heating and cooling apparatus, and a thermometer, 937 parts by mass of polyester resin (Mn 20000) obtained from sebacic acid and 1,6-hexanediol (a molar ratio of 1:1) and 28 parts by mass of phthalic anhydride were introduced and caused to react for 1 hour at 180° C. Thus, the core resin (b1) representing a polyester resin was obtained. Mn of the core resin (b1) was measured under the conditions described in Manufacturing Example 1 above, and Mn of the core resin (b1) was 20000.

One thousand and sixty parts by mass of the obtained core resin (b1) and 1300 parts by mass of acetone were introduced and stirred in a beaker, to thereby uniformly dissolve the core resin (b1) in acetone. Thus, the solution (Y1) for forming the core resin (b1) was obtained. A solid content of the resin in the solution (Y1) for forming the core resin (b1) was measured as 45 mass %.

Manufacturing Example 4

Manufacturing of Solution (Y2) for Forming Core Resin (b2)

In a reaction vessel provided with a stirrer, a heating and cooling apparatus, and a thermometer, 966 parts by mass of polyester resin (Mn 5000) obtained from sebacic acid and 1,6-hexanediol (a molar ratio of 1:1) and 300 parts by mass of acetone were introduced and stirred, to thereby uniformly dissolve the polyester resin in acetone. In this solution, 34 parts by mass of IPDI were introduced and caused to react for 6 hours at 80° C. When an NCO value attained to 0, 28 parts by mass of phthalic anhydride were further added and caused to react for 1 hour at 180° C. Thus, the core resin (b2) representing a urethane-modified polyester resin was obtained. Mn of the core resin (b2) was measured under conditions below, and Mn of the core resin (b2) was 25000.

Measurement Apparatus: "HLC-8220GPC" manufactured by Tosoh Corporation

Column: "GUARDCOLUMN c" (one) and "TSKGEL ca-M" (one)

Sample Solution: 0.125 mass % of dimethylformamide solution

Amount of Injection of Dimethylformamide Solution into Column: 100 μl

Flow Rate: 1 ml/min.

Measurement Temperature: 40° C.

Detection Apparatus: Refraction index detector

Reference Material: 12 standard polystyrenes manufactured by Tosoh Corporation (TSK standard POLYSTYRENE) (molecular weight: 500, 1050, 2800, 5970, 9100, 18100, 37900, 96400, 190000, 355000, 1090000, 2890000)

Eight hundred and twenty parts by mass of the obtained core resin (b2) and 1000 parts by mass of acetone were introduced and stirred in a beaker, to thereby uniformly dissolve the core resin (b2) in acetone. Thus, the solution (Y2) for forming the core resin (b2) was obtained. A solid content of the resin in the solution (Y2) for forming the core resin (b2) was measured as 45 mass %.

Manufacturing Example 5

Manufacturing of Solution (Y3) for Forming Core Resin (b3)

In a reaction vessel provided with a stirrer, a heating and cooling apparatus, and a thermometer, 937 parts by mass of polyester resin (Mn 40000) obtained from sebacic acid, terephthalic acid, and 1,6-hexanediol (a molar ratio of 0.8:0.2:1) and 28 parts by mass of phthalic anhydride were introduced and caused to react for 1 hour at 180° C. Thus, the core resin (b3) representing a polyester resin was obtained. Mn of the core resin (b3) was measured under the conditions described in Manufacturing Example 1 above, and Mn of the core resin (b3) was 40000.

Nine hundred and forty parts by mass of the obtained core resin (b3) and 1300 parts by mass of acetone were introduced and stirred in a beaker, to thereby uniformly dissolve the core resin (b3) in acetone. Thus, the solution (Y3) for forming the core resin (b3) was obtained. A solid content of the resin in the solution (Y3) for forming the core resin (b3) was measured as 42 mass %.

Manufacturing Example 6

Manufacturing of Solution (Y4) for Forming Core Resin (b4)

In a reaction vessel provided with a stirrer, a heating and cooling apparatus, and a thermometer, 975 parts by mass of polyester resin (Mn 7000) obtained from sebacic acid, terephthalic acid, and 1,6-hexanediol (a molar ratio of 0.8:0.2:1) and 1300 parts by mass of acetone were introduced and stirred, to thereby uniformly dissolve the polyester resin in acetone. In this solution, 25 parts by mass of IPDI were introduced and caused to react for 6 hours at 80° C. When an NCO value attained to 0, 28 parts by mass of phthalic anhydride were further added and caused to react for 1 hour at 180° C. Thus, the core resin (b4) representing a urethane-modified polyester resin was obtained. Mn of the core resin (b4) was measured under the conditions described in Manufacturing Example 4 above, and Mn of the core resin (b4) was 35000.

One thousand parts by mass of the obtained core resin (b4) and 1000 parts by mass of acetone were introduced and stirred in a beaker, to thereby uniformly dissolve the core resin (b4) in acetone. Thus, the solution (Y4) for forming the core resin (b4) was obtained. A solid content of the resin in the solution (Y4) for forming the core resin (b4) was measured as 45 mass %.

Manufacturing Example 7

Manufacturing of Solution (Y5) for Forming Core Resin (b5)

In a reaction vessel provided with a stirrer, a heating and cooling apparatus, and a thermometer, 937 parts by mass of polyester resin (Mn 3000) obtained from terephthalic acid, isophthalic acid, and ethylene glycol (a molar ratio of 0.6:0.4:1) and 28 parts by mass of phthalic anhydride were introduced and caused to react for 1 hour at 180° C. Thus, the core resin (b5) representing a polyester resin was obtained. Mn of the core resin (b5) was measured under the conditions described in Manufacturing Example 1 above, and Mn of the core resin (b5) was 30000.

One thousand parts by mass of the obtained core resin (b5) and 1300 parts by mass of acetone were introduced and stirred in a beaker, to thereby uniformly dissolve the core resin (b5) in acetone. Thus, the solution (Y5) for forming the core resin (b5) was obtained. A solid content of the resin in the solution (Y5) for forming the core resin (b5) was measured as 43 mass %.

Manufacturing Example 8

Manufacturing of Solution (Y6) for Forming Core Resin (b6)

In a reaction vessel provided with a stirrer, a heating and cooling apparatus, and a thermometer, 975 parts by mass of polyester resin (Mn 7000) obtained from isophthalic acid, terephthalic acid, and ethylene glycol (a molar ratio of 0.4:0.6:1) and 1300 parts by mass of acetone were introduced and stirred, to thereby uniformly dissolve the polyester resin in acetone. In this solution, 25 parts by mass of IPDI were introduced and caused to react for 6 hours at 80° C. When an NCO value attained to 0, 28 parts by mass of phthalic anhydride were further added and caused to react for 1 hour at 180° C. Thus, the core resin (b6) representing a urethane-modified polyester resin was obtained. Mn of the core resin (b6) was measured under the conditions described in Manufacturing Example 4 above, and Mn of the core resin (b6) was 35000.

One thousand parts by mass of the obtained core resin (b6) and 1000 parts by mass of acetone were introduced and stirred in a beaker, to thereby uniformly dissolve the core resin (b6) in acetone. Thus, the solution (Y6) for forming the core resin (b6) was obtained. A solid content of the resin in the solution (Y6) for forming the core resin (b6) was measured as 45 mass %.

Manufacturing Example 9

Manufacturing of Solution (Y7) for Forming Core Resin (b7)

In a reaction vessel provided with a stirrer, a heating and cooling apparatus, and a thermometer, 875 parts by mass of polyester resin (Mn 1500) obtained from sebacic acid and 1,6-hexanediol (a molar ratio of 1:1) and 1300 parts by mass of acetone were introduced and stirred, to thereby uniformly dissolve the polyester resin in acetone. In this solution, 125 parts by mass of IPDI were introduced and caused to react for 6 hours at 80° C. When an NCO value attained to 0, 28 parts by mass of phthalic anhydride were further added and caused to react for 1 hour at 180° C. Thus, the core resin (b7) representing a urethane-modified polyester resin was obtained. Mn of the core resin (b7) was measured under the conditions described in Manufacturing Example 4 above, and Mn of the core resin (b7) was 40000.

One thousand parts by mass of the obtained core resin (b7) and 1000 parts by mass of acetone were introduced and stirred in a beaker, to thereby uniformly dissolve the core resin (b7) in acetone. Thus, the solution (Y7) for forming the core resin (b7) was obtained. A solid content of the resin in the solution (Y7) for forming the core resin (b7) was measured as 45 mass %.

Manufacturing Example 10

Manufacturing of Solution (Y8) for Forming Core Resin (b8)

In a reaction vessel provided with a stirrer, a heating and cooling apparatus, and a thermometer, 966 parts by mass of polyester resin (Mn 5000) obtained from terephthalic acid, isophthalic acid, and an adduct of propylene oxide to bisphenol A (a molar ratio of 0.6:0.4:1) and 1300 parts by mass of acetone were introduced and stirred, to thereby uniformly dissolve the polyester resin in acetone. In this solution, 34 parts by mass of IPDI were introduced and caused to react for 6 hours at 80° C. When an NCO value attained to 0, 28 parts by mass of phthalic anhydride were further added and caused to react for 1 hour at 180° C. Thus, the core resin (b8) representing a urethane-modified polyester resin was obtained. Mn of the core resin (b8) was measured under the conditions described in Manufacturing Example 4 above, and Mn of the core resin (b8) was 25000.

One thousand parts by mass of the obtained core resin (b8) and 1000 parts by mass of acetone were introduced and stirred in a beaker, to thereby uniformly dissolve the core resin (b8) in acetone. Thus, the solution (Y8) for forming the core resin (b8) was obtained. A solid content of the resin in the solution (Y8) for forming the core resin (b8) was measured as 45 mass %.

Manufacturing Example 11

Manufacturing of Dispersion Liquid (P1) of Pigment

In a beaker, 20 parts by mass of acid-treated copper phthalocyanine ("FASTGEN BLUE FDB-14" manufactured by DIC Corporation), 5 parts by mass of a dispersant for pigment "AJISPER PB-821" (manufactured by Ajinomoto Fine-Techno Co., Inc.), and 75 parts by mass of acetone were introduced and stirred, to thereby uniformly disperse acid-treated copper phthalocyanine. Thereafter, copper phthalocyanine was finely dispersed with the use of a bead mill. Thus, a dispersion liquid of a pigment was obtained. A laser particle size distribution analyzer ("LA-920" manufactured by Horiba, Ltd.) was used to measure a volume average particle size of the pigment (copper phthalocyanine) in the dispersion liquid of the pigment, which was 0.2 μm.

Example 1

Forty parts by mass of the solution (Y1) for forming the core resin (b1) and 20 parts by mass of the dispersion liquid of the pigment (P1) were introduced in a beaker and stirred at 8000 rpm with the use of TK AUTO HOMO MIXER [manufactured by PRIMIX Corporation] at 25° C. Thus, a resin solution (Y11) in which the pigment was uniformly dispersed was obtained.

In another beaker, 67 parts by mass of MORESCO WHITE P-40 (manufactured by MORESCO Corporation, flash point of 142° C.) and 11 parts by mass of the dispersion liquid (W1) of the shell particles (A1) were introduced to uniformly disperse the shell particles (A1). Then, while TK AUTO HOMO MIXER was used at 25° C. to perform stirring at 10000 rpm, 60 parts by mass of the resin solution (Y11) were introduced and stirred for 2 minutes.

A liquid mixture thus obtained was introduced in a reaction vessel provided with a stirrer, a heating and cooling apparatus, a thermometer, and a desolventizer, and a temperature was raised to 35° C. At a reduced pressure of 0.039 MPa at 35° C., acetone was distilled out until a concentration of acetone in the liquid mixture described above was not higher than 0.5 mass %. Thus, a liquid developer (X-1) was obtained.

Based on calculation of an amount of preparation of the liquid developer (X-1), 72.3 mass % of the core resin (b1), 7.7 mass % of the shell resin (A1), 16 mass % of copper phthalocyanine, and 4.0 mass % of the dispersant for pigment were contained. The resin contained in the liquid developer (X-1) contained 90.4 mass % of the first resin.

Example 2

Forty parts by mass of the solution (Y2) for forming the core resin (b2) and 25 parts by mass of the dispersion liquid of the pigment (P1) were introduced in a beaker and stirred at 8000 rpm with the use of TK AUTO HOMO MIXER (manufactured by PRIMIX Corporation) at 25° C. Thus, a resin solution (Y12) in which the pigment was uniformly dispersed was obtained.

In another beaker, 67 parts by mass of MORESCO WHITE P-70 (manufactured by MORESCO Corporation, flash point of 180° C.) and 9 parts by mass of the dispersion liquid (W1) of the shell particles (A1) were introduced to uniformly disperse the shell particles (A1). Then, while TK AUTO HOMO MIXER was used at 25° C. to perform stirring at 10000 rpm, 60 parts by mass of the resin solution (Y12) were introduced and stirred for 2 minutes.

A liquid mixture thus obtained was introduced in a reaction vessel provided with a stirrer, a heating and cooling apparatus, a thermometer, and a desolventizer, and a temperature was raised to 35° C. At a reduced pressure of 0.039 MPa at 35° C., acetone was distilled out until a concentration of acetone in the liquid mixture described above was not higher than 0.5 mass %. Thus, a liquid developer (X-2) was obtained.

Based on calculation of an amount of preparation of the liquid developer (X-2), 69.3 mass % of the core resin (b2), 6.6 mass % of the shell resin (A1), 19.3 mass % of copper phthalocyanine, and 4.8 mass % of the dispersant for pigment were contained. The resin contained in the liquid developer (X-2) contained 91.3 mass % of the first resin.

Example 3

A liquid developer (X-3) was obtained in accordance with the method described in Example 2 above, except that an amount of addition of the dispersion liquid (W1) of the shell resin (A1) was set to 17 parts by mass. Based on calculation of an amount of preparation of the liquid developer (X-3), 65.5 mass % of the core resin (b2), 11.8 mass % of the shell resin (A1), 18.2 mass % of copper phthalocyanine, and 4.5 mass % of the dispersant for pigment were contained. The resin contained in the liquid developer (X-3) contained 84.8 mass % of the first resin.

Example 4

A liquid developer (X-4) was obtained in accordance with the method described in Example 1 above, except that the solution (Y3) for forming the core resin (b3) was employed instead of the solution (Y1) for forming the core resin (b1).

Example 5

A liquid developer (X-5) was obtained in accordance with the method described in Example 1 above, except that the solution (Y4) for forming the core resin (b4) was employed instead of the solution (Y1) for forming the core resin (b1).

Example 6

A liquid developer (X-6) was obtained in accordance with the method described in Example 1 above, except that the solution (Y5) for forming the core resin (b5) was employed instead of the solution (Y1) for forming the core resin (b1).

Comparative Example 1

A liquid developer (X-11) was obtained in accordance with the method described in Example 1 above, except that the solution (Y6) for forming the core resin (b6) was employed instead of the solution (Y1) for forming the core resin (b1) and an amount of addition of the dispersion liquid (W1) of the shell particles (A1) was set to 31 parts by mass. Based on calculation of an amount of preparation of the liquid developer (X-11), 59.7 mass % of the core resin (b6), 19.6 mass % of the shell resin (A1), 16.5 mass % of copper phthalocyanine, and 4.1 mass % of the dispersant for pigment were contained.

Comparative Example 2

A liquid developer (X-12) was obtained in accordance with the method described in Example 1 above, except that the solution (Y7) for forming the core resin (b7) was employed instead of the solution (Y1) for forming the core resin (b1).

Comparative Example 3

A liquid developer (X-13) was obtained in accordance with the method described in Example 1 above, except that the solution (Y8) for forming the core resin (b8) was employed instead of the solution (Y1) for forming the core resin (b1).

Comparative Example 4

A liquid developer (X-14) was obtained in accordance with the method described in Example 1 above, except that ISOPAR L (flash point of 66° C.) was employed instead of MORESCO WHITE P-40 (manufactured by MORESCO Corporation, flash point of 142° C.).

<H1 and H2>

Twelve standard polyesters (TSK standard POLYSTYRENE manufactured by Tosoh Corporation) (molecular weight: 500, 1050, 2800, 5970, 9100, 18100, 37900, 96400, 190000, 355000, 1090000, 2890000) were employed as standard samples, standard polyesters and resins contained in toner particles in Examples 1 to 6 and Comparative Examples 1 to 3 were heated from 0° C. to 180° C. at a rate of 10° C./min., and a difference between an amount of heat of the standard sample and an amount of heat of the resin was measured. Then, a difference in amount of heat H1 at the time of first temperature increase and a difference in amount of heat H2 at the time of second temperature increase were found. Table 1 shows results.

<Median Diameter D50>

A flow particle image analyzer (FPIA-3000S manufactured by Sysmex Corporation) was used to measure an average particle size of the liquid developers in Examples 1 to 6 and Comparative Examples 1 to 4. Specifically, a suspension was obtained by introducing 50 mg of the liquid developer into Isopar L (20 g) containing 30 mg of S13940 (manufactured by Japan Lubrizol Limited) as a dispersant. An ultrasound disperser (manufactured by Velvo-Clear, ultrasonic cleaner model VS-150) was used to subject the resultant suspension to dispersion treatment for approximately 5 minutes. The flow particle image analyzer was used to measure median diameter D50 at the time when particle size distribution of the resultant sample was measured based on volume.

<$G'(T_0)/G'(T_0+10)$>

Approximately 5 g of the liquid developer was taken for centrifugation, for removal of a supernatant. Thereafter, cleaning with hexane was carried out, and then drying for 2 hours at a room temperature was carried out with the use of a vacuum dryer. A viscoelasticity measurement apparatus (ARES of TA Instruments, Japan) was used to measure viscoelasticity of a dried sample under conditions shown below.

Jig: Parallel plates each having a thickness of 8 mm

Frequency: 1 Hz

Distortion Factor: 1%

Rate of Temperature Increase: 3° C./min.

Range of Measurement Temperature: 40 to 160° C.

$G'(T_0)/G'(T_0+10)$ was calculated based on the obtained viscoelastic characteristics. Temperature dependency of a storage elastic modulus of a solid content of the liquid developer was plotted in a graph, with the abscissa representing temperature $T_0$ and the ordinate representing storage elastic modulus $G'(T_0)$, any two points on the graph satisfying 50° C.$\leq T_0 \leq$70° C. were approximated by a straight line to thereby find a gradient, and a temperature at which the gradient was greatest was defined as $T_0$.

<Fixation Process>

An image was formed by using an image forming apparatus shown in FIG. 1.

A construction of the image forming apparatus shown in FIG. 1 is shown below. A liquid developer 21 is brought up from a development tank 22 by an anilox roller 23. Excessive liquid developer 21 on anilox roller 23 is scraped off by an anilox restriction blade 24, and remaining liquid developer 21 is sent to a leveling roller 25. Liquid developer 21 is adjusted to be uniform and small in thickness, on leveling roller 25.

Liquid developer 21 on leveling roller 25 is sent to a development roller 26. The excessive liquid developer on development roller 26 is scraped off by a development cleaning blade 27, and remaining liquid developer 21 is charged by a development charger 28 and developed on a photoconductor 29. Specifically, a surface of photoconductor 29 is evenly charged by a charging portion 30, and an exposure portion 31 arranged around photoconductor 29 emits light based on prescribed image information to the surface of photoconductor 29. Thus, an electrostatic latent image based on the prescribed image information is formed on the surface of photoconductor 29. As the formed electrostatic latent image is developed, a toner image is formed on photoconductor 29. The excessive liquid developer on photoconductor 29 is scraped off by a cleaning blade 32.

The toner image formed on photoconductor 29 is primarily transferred to an intermediate transfer element 33 at a primary transfer portion 37, and the liquid developer transferred to intermediate transfer element 33 is secondarily transferred to a recording medium 40 such as paper at a secondary transfer portion 38. The liquid developer transferred to recording medium 40 is fixed by fixation rollers **36*a* and 36*b*. The liquid developer which remained on intermediate transfer element 33 without being secondarily transferred is scraped off by an intermediate transfer element cleaning portion 34**.

In the present Example, the surface of photoconductor 29 was positively charged by charging portion 30, a potential of intermediate transfer element 33 was set to −400 V, and a potential of a secondary transfer roller 35 was set to −1299 V. OK top coat (manufactured by Oji Paper Co., Ltd., 128 g/cm$^2$) was employed as a recording medium and a velocity of transportation of the recording medium was set to 400 mm/s.

<High-Temperature Offset>

After an image was formed with the use of the image forming apparatus shown in FIG. 1, a circumferential surface of the fixation roller was observed. Table 2 shows results. In Table 2, a case that the circumferential surface of the fixation roller was not contaminated was denoted as A1 and a case that the circumferential surface of the fixation roller was contaminated was denoted as D1. It can be concluded that no high-temperature offset took place if the circumferential surface of the fixation roller was not contaminated.

<Fixability>

An image fixed with the use of the image forming apparatus shown in FIG. 1 was subjected to a tape peel test, and density of an image (ID) which peeled off was found. Table 2 shows results. In Table 2, a case of image density<0.05 was denoted as A2, a case of 0.05≤image density<0.1 was denoted as B2, a case of 0.1≤image density<0.2 was denoted as C2, and a case of 0.2≤image density was denoted as D2. Lower image density indicates that a fixed image is less likely to be peeled off by the tape, and it can be concluded that such a liquid developer is excellent in fixability.

<Degree of Gloss>

Seventy-five-degree Gloss Meter (VG-2000 manufactured by Nippon Denshoku Industries Co., Ltd.) was used to measure a degree of gloss of a fixed image. Table 2 shows results. In Table 2, a degree of gloss not lower than 80 is denoted as A3, a degree of gloss not lower than 70 and lower than 80 is denoted as B3, a degree of gloss not lower than 60 and lower than 70 is denoted as C3, and a degree of gloss lower than 60 is denoted as D3. As a degree of gloss is higher, it can be concluded that such a liquid developer is excellent in gloss.

<Document Offset>

While fixed images were layered, load of 10 g/m$^2$ was applied thereto and stored for 1 week at 50° C. Thereafter, two images were separated from each other and whether or not the images were damaged at the time of separation was checked. Table 2 shows results. In Table 2, a case that the images were not damaged at the time of separation is denoted as A4 and a case that the images were slightly damaged at the time of separation is denoted as B4. It can be concluded that no document offset took place if the images were not damaged at the time of separation.

TABLE 1

| | Insulating | Resin | | | | | |
|---|---|---|---|---|---|---|---|
| | Liquid Flash Point (° C.) | Core Resin | Content of First Resin (Mass %) | Content of Aliphatic Monomer (Mass %) | H1 | H2 | Urethane Modification |
| Example 1 | 142 | b1 | 90 | 100 | 65 | 60 | No |
| Example 2 | 180 | b2 | 91 | 100 | 60 | 50 | Yes |
| Example 3 | 180 | b2 | 85 | 90 | 60 | 50 | Yes |
| Example 4 | 142 | b3 | 90 | 90 | 35 | 30 | No |
| Example 5 | 142 | b4 | 90 | 80 | 30 | 20 | Yes |
| Example 6 | 142 | b5 | 90 | 50 | Undetectable | Undetectable | No |
| Comparative Example 1 | 142 | b6 | 90 | 70 | Undetectable | Undetectable | Yes |
| Comparative Example 2 | 142 | b7 | 75 | 100 | 10 | Undetectable | Yes |
| Comparative Example 3 | 142 | b8 | 90 | 0 | Undetectable | Undetectable | Yes |
| Comparative Example 4 | 66 | b1 | 90 | 100 | 60 | 50 | Yes |

The "content of first resin" and the "content of aliphatic monomer" in Table 1 are values calculated from an amount of preparation of the liquid developer in each Example and each Comparative Example. The "content of aliphatic monomer" corresponds to a ratio of a constitutional unit derived from an aliphatic monomer occupied in a constitutional unit derived from an acid component and a constitutional unit derived from an alcohol component.

TABLE 2

| | Liquid Developer | | | Fixation | High- | | | |
|---|---|---|---|---|---|---|---|---|
| | $G'(T_0)/G'(T_0+10)$ | $T_0$ (° C.) | D50 (μm) | Temperature (° C.) | Temperature Offset | Fixability | Degree of Gloss | Document Offset |
| Example 1 | 90 | 52 | 1.74 | 75 | A1 | B2 | A3 | B4 |
| Example 2 | 70 | 57 | 1.66 | | A1 | A2 | A3 | A4 |
| Example 3 | 40 | 55 | 1.36 | | A1 | B2 | B3 | A4 |
| Example 4 | 20 | 57 | 1.81 | | A1 | B2 | C3 | B4 |
| Example 5 | 15 | 54 | 1.54 | | A1 | C2 | C3 | A4 |
| Example 6 | 20 | 65 | 1.66 | | A1 | C2 | C3 | B4 |
| Comparative Example 1 | 7 | 65 | 2.02 | | A1 | D2 | D3 | A4 |
| Comparative Example 2 | 3 | 65 | 1.35 | | A1 | D2 | D3 | A4 |
| Comparative Example 3 | 3 | 60 | 1.96 | | A1 | D2 | D3 | A4 |
| Comparative Example 4 | 70 | 57 | 1.77 | | D1 | A2 | A3 | A4 |

As shown in Table 1, in Examples 1 to 5 and Comparative Example 4, H1 was not lower than 5 and not higher than 70 and H2/H1 was not lower than 0.2 and not higher than 1.0. Therefore, it can be concluded that the resin contained in toner particles in Examples 1 to 5 and Comparative Example 4 has crystallinity. In Example 6 and Comparative Examples 1 to 3, at least one of H1 and H2 was undetectable. Therefore, it can be concluded that the resin contained in toner particles in Example 6 and Comparative Examples 1 to 3 does not have crystallinity. In Example 6 and Comparative Examples 1 and 3, a ratio of a constitutional unit derived from an aliphatic monomer occupied in a constitutional unit derived from an acid component and a constitutional unit derived from an alcohol component is low, and hence it is considered that the resin contained in toner particles does not have crystallinity. In Comparative Example 2, since the content of the first resin is low, it is considered that the resin contained in toner particles does not have crystallinity.

Figure 2:
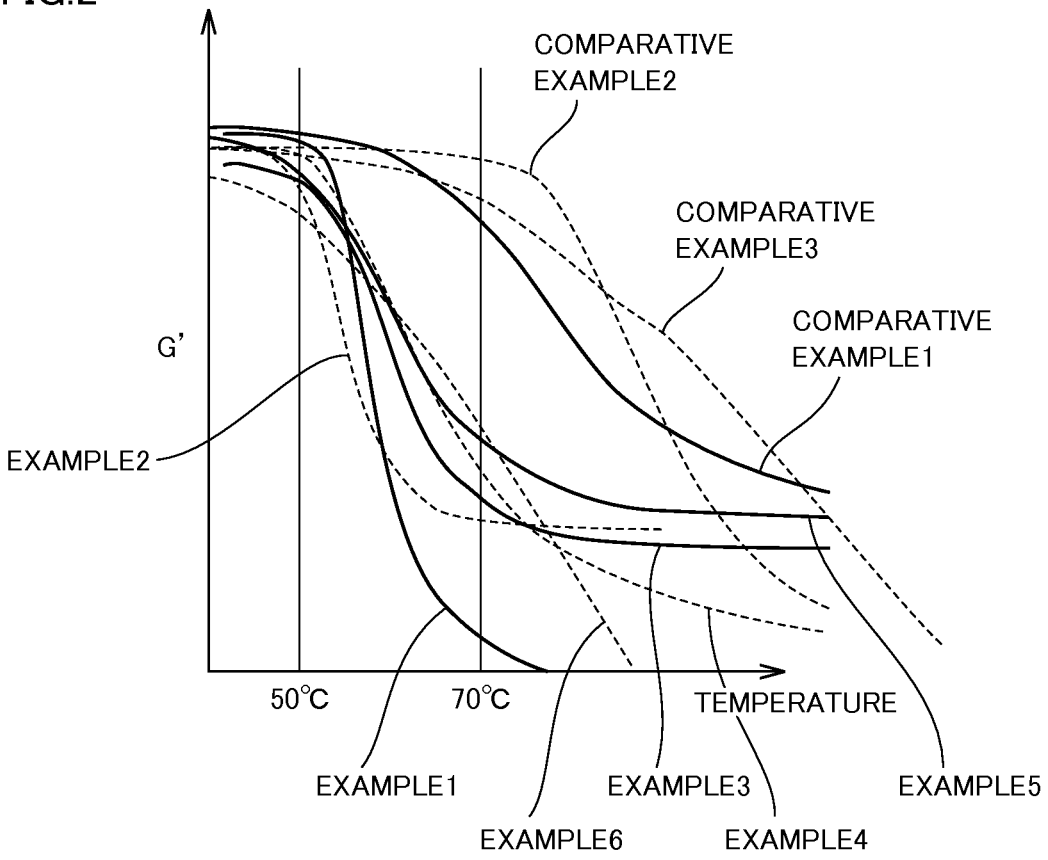
FIG. 2 is a graph showing results in Examples.

As shown in Table 2, in Examples 1 to 6, fixation was carried out at 75° C. and occurrence of high-temperature offset could be prevented. The reason may be as shown below. In Examples 1 to 6, relation of $G'(T_0)/G'(T_0+10) \geq 10$ is satisfied, and hence the storage elastic modulus of the solid content of the liquid developer has a sharp gradient in a range from 50° C. to 70° C. as shown in FIG. 2. Therefore, toner particles can sufficiently be molten and fixed at 75 degrees. In Examples 1 to 6, since the insulating liquid has a flash point thereof not lower than 100° C., it tends to remain on surfaces of toner particles during fixation. Therefore, even though fixation is carried out at such a low temperature as 75° C., high-temperature offset is less likely to occur. FIG. 2 shows a graph showing results in Examples, in which the abscissa represents a temperature and the ordinate represents a storage elastic modulus of a solid content of a liquid developer.

In Comparative Examples 1 to 3, fixability and gloss lowered. The reason may be as shown below. Since relation of $G'(T_0)/G'(T_0+10) < 10$ is satisfied, a storage elastic modulus of the solid content of the liquid developer does not have a sharp gradient in a range from 50° C. to 70° C. as shown in FIG. 2. Therefore, since toner particles are not softened at 75 degrees, fixation at such a low temperature as 75° C. is difficult.

In Comparative Example 4, high-temperature offset took place. The reason may be because the flash point of the insulating liquid is lower than 100° C., and hence the insulating liquid is less likely to remain on the surface of toner particles during fixation.

Fixability was better in Examples 1 to 4 than in Examples 5 to 6. The reason may be because a ratio of a constitutional unit derived from an aliphatic monomer occupied in a constitutional unit derived from an acid component and a constitutional unit derived from an alcohol component is not lower than 90 mass % in Examples 1 to 4, whereas a ratio of a constitutional unit derived from an aliphatic monomer occupied in a constitutional unit derived from an acid component and a constitutional unit derived from an alcohol component is not higher than 80 mass % in Examples 5 to 6. In addition, fixability was better in Example 2 than in Example 1. The reason may be because the first resin is a polyester resin not subjected to urethane modification in Example 1, whereas the first resin is a urethane-modified polyester resin in Example 2.

Occurrence of document offset could be prevented in Examples 2 to 3 and 5, rather than in Examples 1, 4, and 6. The reason may be because the first resin is a polyester resin not subjected to urethane modification in Examples 1, 4, and 6, whereas the first resin is a urethane-modified polyester resin in Examples 2 to 3 and 5.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A liquid developer, comprising:

an insulating liquid; and toner particles dispersed in said insulating liquid, said insulating liquid having a flash point not lower than 100° C., said toner particles containing a resin, said resin containing 80 mass % or more of a first resin containing a polyester resin or a component derived from the polyester resin, wherein the component derived from the polyester resin is a portion of the first resin excluding a portion derived from an isocyanate group if the first resin is a urethane-modified polyester resin, and a solid content of said liquid developer corresponding to a portion of said liquid developer excluding said insulating liquid satisfying relation of $G'(T_0)/G'(T_0+10) \geq 10$ ($50° C. \leq T_0 \leq 70° C.$), where $G'(T_0)$ represents a storage elastic modulus at a temperature $T_0$ (° C.) and $G'(T_0+10)$ represents a storage elastic modulus at a temperature $(T_0+10)$ (° C.).

2. The liquid developer according to claim 1, wherein said component derived from the polyester resin contains a constitutional unit derived from an acid component and a constitutional unit derived from an alcohol component, and a ratio of a constitutional unit derived from an aliphatic monomer occupied in said constitutional unit derived from the acid component and said constitutional unit derived from the alcohol component is not lower than 90 mass %.

3. The liquid developer according to claim 1, wherein said solid content of said liquid developer satisfies relation of $G'(T_0)/G'(T_0+10) \geq 50$.

4. The liquid developer according to claim 1, wherein said first resin is at least one of the polyester resin or a urethane-modified polyester resin resulting from increase in chain length of said component derived from the polyester resin by a compound containing an isocyanate group.

5. The liquid developer according to claim 1, wherein said resin contains 90 mass % or more of said first resin.

* * * * *